US010522909B2

(12) United States Patent
Martiskainen et al.

(10) Patent No.: US 10,522,909 B2
(45) Date of Patent: Dec. 31, 2019

(54) MULTI-INPUT MULTI-OUTPUT ANTENNA

(71) Applicant: GALTRONICS USA, INC., Tempe, AZ (US)

(72) Inventors: Matti Martiskainen, Upper Tiberias (IL); Vitali Spector, Tiberias (IL)

(73) Assignee: GALTRONICS USA, INC., Tempe, AZ (US)

( * ) Notice: Subject to any disclaimer, the term of this patent is extended or adjusted under 35 U.S.C. 154(b) by 373 days.

(21) Appl. No.: 15/013,572

(22) Filed: Feb. 2, 2016

(65) Prior Publication Data

US 2016/0226144 A1 Aug. 4, 2016

Related U.S. Application Data

(60) Provisional application No. 62/111,089, filed on Feb. 2, 2015.

(51) Int. Cl.
*H01Q 5/392* (2015.01)

(52) U.S. Cl.
CPC ..... *H01Q 5/392* (2015.01)

(58) Field of Classification Search
CPC ..... H01Q 5/30; H01Q 5/392; H01Q 1/243; H01Q 1/521; H01Q 9/42; H01Q 21/28
See application file for complete search history.

(56) References Cited

U.S. PATENT DOCUMENTS

2005/0206575 A1* 9/2005 Chadwick ..... H01Q 1/246 343/797
2013/0002510 A1 1/2013 Azulay et al.
2013/0027268 A1* 1/2013 Ohno ..... H01Q 9/285 343/818
2013/0076580 A1 3/2013 Zhang et al.
2014/0043190 A1* 2/2014 Vummidi Murali ..... H01Q 1/38 343/700 MS
2014/0361941 A1 12/2014 Jenwatanavet et al.

FOREIGN PATENT DOCUMENTS

CN 101442153 5/2009
CN 102301531 12/2011
CN 103545610 1/2014

OTHER PUBLICATIONS http://www.antenna-theory.com/antennas/aperture/ifa.php, printed 2019 (cited to establish inherent features).*

(Continued)

*Primary Examiner* — Graham P Smith
(74) *Attorney, Agent, or Firm* — Brion Raffoul

(57) ABSTRACT

A wireless device includes an antenna structure having at least one parallel resonance element and a plurality of serial resonance components. The at least one parallel resonance element may be configured to radiate in at least one frequency. The plurality of serial resonance components may be configured to radiate in a plurality of frequencies. The antenna structure may further include a distributed feed element configured to couple to the parallel resonance element and the serial resonance components and serve as a radiofrequency signal feed. The wireless device may include two or more similar antenna structures.

19 Claims, 17 Drawing Sheets

(56) References Cited

OTHER PUBLICATIONS

The International Bureau of WIPO, International Preliminary Report on Patentability for International Application No. PCT/IB2016/050527 dated Aug. 17, 2017.
Jae-Min Lee et al: "A Compact Ultrawideband MIMO Antenna With WLAN Band-Rejected Operation for Mobile Devices", IEEE Antennas and Wireless Propagation Letters, IEEE, Piscataway, NJ, US, vol. 11, Jan. 1, 2012 (Jan. 1, 2012),pp. 990-993.
Sun Si Cheng et al: "Compact MIMO PI FA for LTE/WWAN operation in the mobile application", Proceedings of 2014 3rd Asia-Pacific Conference on Antennas and Propagation , IEEE, Jul. 26, 2014 (Jul. 26, 2014), pp. 26-28, XP032710418, DOI: 10.1109/APCAP.2014.6992401 [retrieved on Dec. 18, 2014].
Marti Skainen M et al: "Planar antenna for a cellular phone", Microwaves , Communications, Antennas and Electronics Systems, 2009. COMCAS 2009. EEE International Conference On, IEEE, Piscataway, NJ, USA, Nov. 9, 2009 (Nov. 9, 2009), pp. 1-5.
European Patent Office International Searching Authority, International Search Report and Writte Opinion for International Application No. PCT/IB2016/050527 dated Dec. 6, 2016.
Office Action received from the Chinese Patent Office dated May 24, 2019.

* cited by examiner

MULTI-INPUT MULTI-OUTPUT ANTENNA

CROSS-REFERENCE TO RELATED APPLICATION(S)

This application claims the benefit of U.S. Provisional Patent Application Ser. No. 62/111,089, filed Feb. 2, 2015, the entire content of which is incorporated by reference herein.

TECHNICAL FIELD

The present disclosure relates to antenna structures for wireless devices. Wireless devices described herein may be used for mobile broadband communications.

BACKGROUND

Modern devices, such as Wi-Fi routers, often utilize multiple antennas to improve a throughput of the device. However, when multiple antennas are mounted in close proximity, the antennas can interfere with one another, degrading the performance of the antennas.

SUMMARY

Embodiments of the present disclosure may include a wireless device a multiple-input multiple-output antenna. A multiple-input multiple-output antenna may include a counterpoise, a first antenna structure, and a second antenna structure. The first antenna structure may include a first parallel resonance element configured to resonate in at least one frequency, a first serial resonance component configured to resonate at a first frequency and configured to couple to the first parallel resonance element, and a first distributed feed element connected to a first feed line and configured to deliver a radiofrequency signal and couple to the first parallel resonance element and the first serial resonance component at the first frequency. The second antenna structure may include a second parallel resonance element configured to resonate in at least one frequency, a second serial resonance component configured to resonate at the first frequency and configured to couple to the second parallel resonance element, and a second distributed feed element connected to a second feed line and configured to deliver a radiofrequency signal and couple to the second parallel resonance element and second serial resonance component at the second frequency. The first parallel resonance element and the second parallel resonance element may be at least partially defined by the counterpoise.

In another embodiment consistent with the present disclosure, a wireless device may include a conductive chassis, a first conductive coupling element having one end connected to the conductive chassis, the first conductive coupling element and the conductive chassis cooperating to form a first slit therebetween, and a first elongate feed element disposed at least partially in the slit between the first coupling element and the chassis. The wireless device may further include a second conductive coupling element having one end connected to the conductive chassis, the second conductive coupling element and the conductive chassis cooperating to form a second slit therebetween, and a second elongate feed element disposed at least partially in the slit between the second coupling element and the chassis. A portion of the first coupling element and the chassis may be configured to couple together and radiate in at least one frequency band when supplied with a radiofrequency signal in the at least one frequency band by the first elongate feed element, and a portion of the second coupling element and the chassis may be configured to couple together and radiate in the at least one frequency band when supplied with a radiofrequency signal in the at least one frequency band by the second elongate feed element.

DETAILED DESCRIPTION OF EMBODIMENTS

Reference will now be made in detail to exemplary embodiments of the present disclosure, examples of which are illustrated in the accompanying drawings. Wherever possible, the same reference numbers will be used throughout the drawings to refer to the same or like parts.

Embodiments of the present disclosure relate generally to wide bandwidth antennas provided for use in wireless devices. Multi-band antennas consistent with the present disclosure may be employed in mobile devices for cellular communications, and may operate at frequencies ranging from approximately 700 MHz to approximately 2.7 GHz. Multi-band antennas consistent with the present disclosure may further be employed for any type of application involving wireless communication and may be constructed to operate in appropriate frequency ranges for such applications. Multi-band antennas consistent with the present disclosure may function as coupled resonance circuits and as multiple coupled resonance circuits. In some embodiments consistent with the present disclosure, a plurality of multi-band antennas may be provided within a single wireless device to provide multiple-input multiple-output (MIMO) communications.

Figure 1:
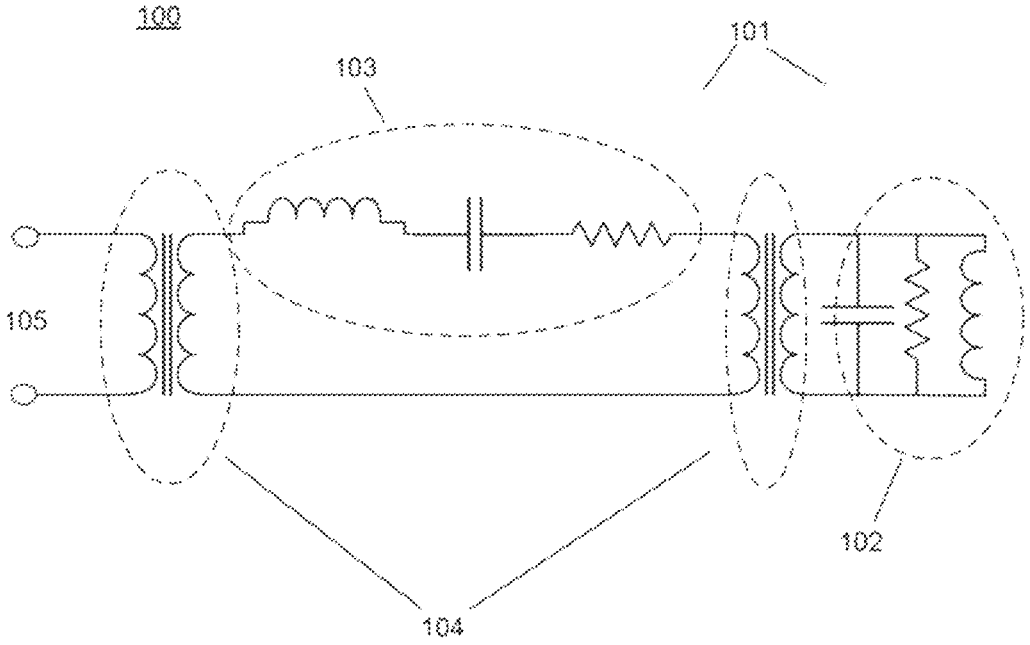
FIG. 1 is an illustration of coupled resonance circuits.

FIG. 1 illustrates a coupled resonance circuit 100 which may be used to provide a model of an antenna. As illustrated in FIG. 1, a coupled resonance circuit may include two resonance circuits 101, at least one coupling portion 104, and a feeding portion 105. Resonance circuits 101 may include a parallel resonance circuit 102 and a serial resonance circuit 103.

As used herein, a parallel resonance circuit describes a circuit model having a high impedance and having resonance characteristics, including, for example, resonance frequency and Q factor, being substantially determined by one or more reactive elements arranged electrically in parallel to one another. Q factor, or antenna quality factor, is inversely related to antenna bandwidth. Thus, an antenna having a low Q factor has a high bandwidth. In contrast, a serial resonance circuit describes a circuit model having a low impedance and having resonance characteristics with low impedance being substantially determined by one or more reactive elements arranged electrically in serial to one another. For example, a parallel resonance circuit may include at least one inductive element and at least one capacitive element arranged in parallel to one another. A serial resonance circuit may include at least one inductive elements and at least one capacitive element arranged serially. Both parallel and serial resonance circuits may include further reactive elements that contribute less significantly to the resonance characteristics of the circuit.

Resonating structural elements of an antenna may be modeled as parallel resonance circuits and serial resonance circuits. For example, as used herein, a parallel resonance element and a serial resonance component may be physical structural elements of an antenna. A structure having one or more parallel resonance elements may be electrically modeled as, or may function as, a parallel resonance circuit. As described herein, a structure having one or more serial resonance components may be electrically modeled as, or may function as, a serial resonance circuit. A structure may be configured to function as either a serial resonance circuit or a parallel resonance circuit, depending, for example, on a frequency of radiofrequency signal that is fed to it or on a location of a point at which a radiofrequency signal is fed to it.

Reactive elements of a structure modeled as a resonance circuit may include, for example, capacitors and inductors. Reactive structural elements of a structure modeled as a resonance circuit may also include any other structure that exhibits reactive (e.g., capacitive and/or inductive) characteristics when carrying an electrical signal. Some structures that may function as reactive elements in a resonance circuit may display frequency dependent reactive characteristics. For example, a capacitive structure may display reactive properties when excited by an electrical signal of a first frequency, but may display different reactive properties when excited by an electrical signal of a second frequency. As described herein, reactive elements of structures modeled as resonance circuits display reactive characteristics at frequencies appropriate for wireless communication performed by antennas of which they are a part.

Structures functional as or modeled by both parallel and serial resonance circuits may be included as distinct structures within an antenna, and/or may include antenna portions that serve as portions of more than one element of an antenna. For example, a structure serving as a portion of a parallel resonance element may also serve as a portion of a ground plane element. In another example, a structural serving as a serial resonance component may also as a portion of a coupling element.

Many other dual roles are possible for a single structural element, and are described in more detail herein.

Elements fitting to a resonance circuit model may further include gaps, spaces, slits, slots, and cavities within, near, between, and around structural elements. That is, structural elements modeled as or functional as a resonance circuit need not be defined by a continuous galvanically connected structure. For example, a slot or slit between two structural elements may function as a serial resonance component or parallel resonance element when carrying a radiofrequency signal.

As illustrated in FIG. 1, coupling portions 104 may be modeled as transformers, displaying no reactivity. In some embodiments, coupling portion 104 may be realized structurally as a coupling element, which may exhibit one or more of inductance and capacitance, or may display no reactivity at all. In the example model as shown, coupled resonance circuit 100 may have a Q factor substantially similar to the resonance circuit 101 displaying the lower Q factor. Thus, in the example model as shown, in order to achieve a low Q factor for the entirety of coupled resonance circuit 100, it may only be required that one of the two resonance circuits 101 have a low Q factor.

As with the resonance circuit elements described above, a coupling element functioning as coupling portion 104 may be a distinct structure within a coupled resonance circuit 100, and/or it may be formed from one or more antenna portions that also serve other functions. In some embodiments, a coupling element may include gaps, spaces, slits, slots, and cavities within, near, between, and around structural elements. For example, a serial resonance component having a structural element sufficiently close to a structural element of a parallel resonance element may couple to the parallel resonance element across the gap between structural elements. In such an arrangement, a coupling element may include portions of structural elements from each of the serial resonance component and the parallel resonance element, as well as the gap between them.

As shown in the model illustrated in FIG. 1, the coupled resonance circuit 100 may operate as follows. Feeding portion 105 may supply a radiofrequency signal which is coupled through a coupling portion 104 to serial resonance circuit 103. The signal is then coupled through another coupling portion 104 to parallel resonance circuit 102. An antenna designed to correspond to the model the illustrated in FIG. 1 may function in a similar fashion, as described in greater detail below.

In operation, an antenna modeled after coupled resonant circuit 100 may display a Q factor substantially similar the Q factor of the one of two resonance circuits 101 having the lower Q factor. Thus, bandwidth of antenna modeled as a coupled resonance circuit 100 may be determined by the lower Q factor resonance circuit 101.

While the Q factor of the coupled resonance circuit 100 may substantially depend on the Q factor of just one of the resonance circuits 101, the frequency at which resonance circuit 100 resonates may be determined by both parallel resonance circuit 102 and serial resonance circuit 103. Accordingly, an antenna may be designed by using a first resonance circuit 101 having a desirable Q factor and coupling it through a coupling portion 104 with a second resonance circuit 101 having characteristics suitable for adjusting the resonance of coupled resonance circuit 100 to a desirable value.

For example, structural elements modeled as a parallel resonance circuit 102 may have a low Q factor, which may be desirable in a wireless antenna because it provides a wide bandwidth. A structural element of parallel resonance circuit 102 may then be coupled via coupling portion 104 to a structural element of a serial resonance circuit 103 provided to adjust the frequency resonance of coupled resonance circuit 100. Thus, in some embodiments consistent with the present disclosure, a structural element of a parallel resonance circuit 102. e.g., a parallel resonance element, providing a desirable Q factor may be coupled with a structural element of a specific serial resonance circuit 103, e.g., a serial resonance element, for tuning to be used at a specific frequency.

Figure 2:
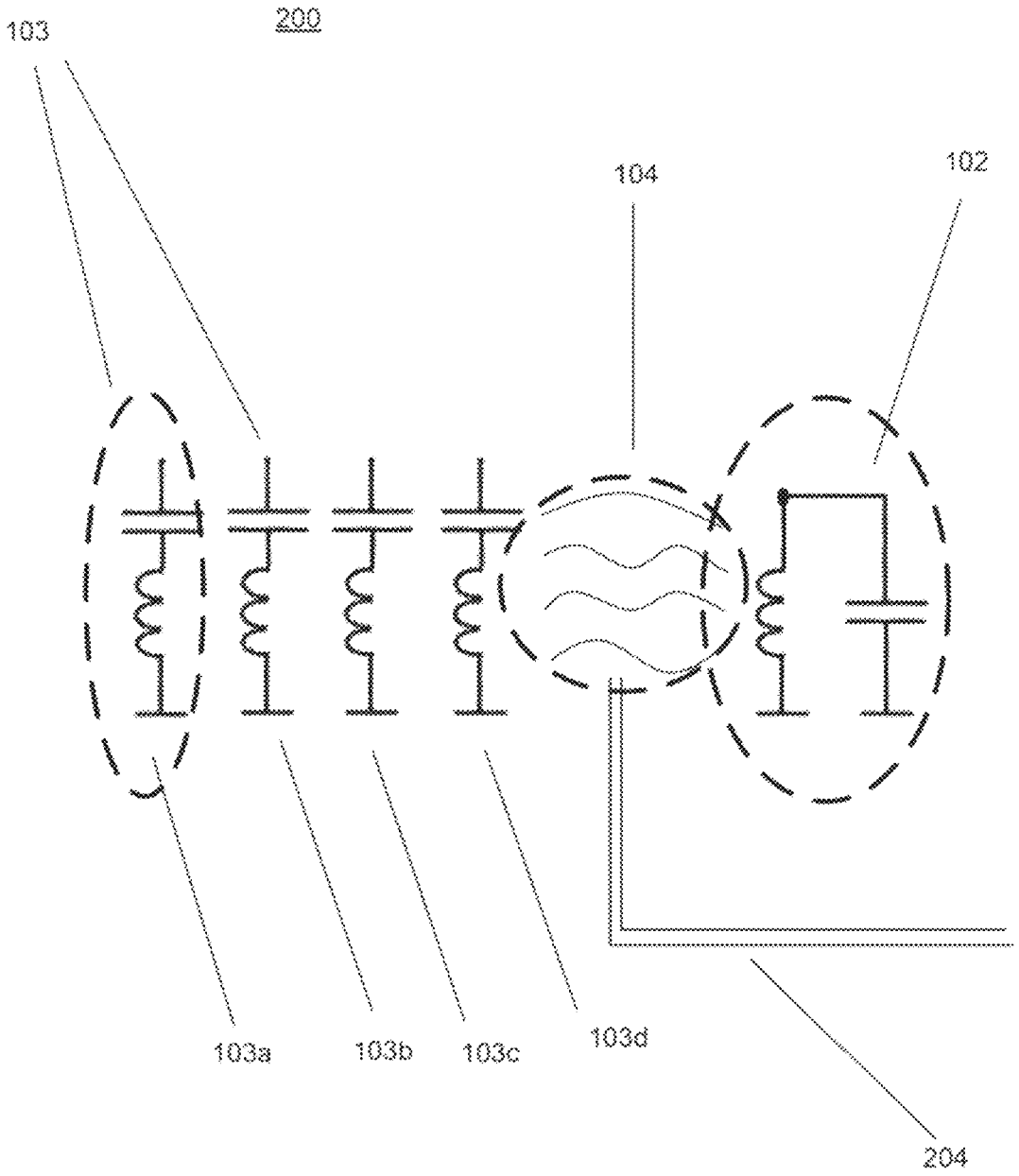
FIG. 2 is an illustration of multi-coupled resonance circuits.

FIG. 2 illustrates a multi-coupled resonance circuit 200 which may be used to provide a model for antenna operation. As illustrated in FIG. 2, multi-coupled resonance circuit 200 may model an antenna structure including at least one parallel resonance element modeled as a parallel resonance circuit 102, a plurality of serial resonance components modeled as serial resonance circuits 103*a*-103*d*, and corresponding coupling elements modeled as coupling portions 104. The following description describes the modeled interactions between circuit components. Structural antenna elements according to the following model may function similarly.

Multi-coupled resonance circuit 200 may operate in a similar fashion to coupled resonance circuit 100. Multi-coupled resonance circuit 200 may be configured such that one of the plurality of serial resonance circuits 103 couples through a coupling portion 104 to one of the at least one parallel resonance circuit 102. The one of the plurality of serial resonance circuits 103, which couples to the at least one parallel resonance circuit 102, may be determined by a frequency of a supplied radiofrequency signal.

For example, a first serial resonance component functioning may be configured to radiate at a first frequency, and may be configured to couple through a coupling element to a parallel resonance element at the first frequency. A second serial resonance component may be configured to radiate at a second frequency, and may be configured to couple through a coupling element to the parallel resonance element at the second frequency. Thus, when an antenna modeled according to the multi-coupled resonance circuit 200 is excited by a signal at the first frequency, the first serial resonance component may couple to the parallel resonance element and radiate at the first frequency. When an antenna modeled according to multi-coupled resonance circuit 200 is excited by a signal at the second frequency, second serial resonance component may couple to the parallel resonance element and radiate at the second frequency.

Further serial resonance components may couple and radiate at additional frequencies. Although FIG. 2 illustrates multi-coupled resonance circuit 200 having four serial resonance circuits 103 and one parallel resonance circuit 102, the disclosed embodiments are not limited to such a configuration. More or fewer serial resonance circuits 103 may be coupled to more or fewer parallel resonance circuits 102 through at least one coupling portion 104.

As discussed above, serial resonance components corresponding to serial resonance circuits 103*a*, 103*b*, 103*c*, 103*d*, may share physical structural components of the antenna and may also share gaps, slots, slits, spaces, windows, and cavities with each other, with the a coupling element corresponding to at least one coupling portion 104 and with a parallel resonance element corresponding to the at least one parallel resonance circuit 102.

In operation, that is, when excited by a radiofrequency signal, different resonance structures modeled as different resonance circuits 101 may be activated, depending on the frequency of the exciting signal. For example, if a combination of one parallel resonance element and one serial resonance component resonates at a particular frequency, then that combination of resonance structures may be activated by a radiofrequency signal having a similar frequency. The activated combination in the a structure modeled after multi-coupled resonance circuit 200 may have a Q factor substantially determined by the activated resonance structure having the lowest Q factor, while the frequency of activation may be determined by the combination of serial resonance component and parallel resonance element that are activated. Thus, a structure modeled after multi-coupled resonance circuit 200 may be configured such that different combinations of resonance structures are activated, depending on the activation frequency. This may permit a designer to optimize performance in specific frequency ranges, by optimizing each resonance structure combination in its activation frequency range.

Achieving the above described selective coupling between one of at least one parallel resonance element and one from among a plurality of serial resonance components may involve the use of a unique coupling element serving as coupling portion 104. A coupling element may be configured to couple radiofrequency signals between the activated parallel resonance element and the activated serial resonance component. The coupling element may be configured to selectively couple a radiofrequency signal between a parallel resonance element and a serial resonance component determined based on a frequency of the radiofrequency signal.

Coupling portion 104 may include a feeding portion 202 for delivering a radiofrequency signal to multi-coupled resonance structure. A feeding portion may carry a radiofrequency signal to or from signal processing portions of a wireless device. The radiofrequency signal carried by the feeding portion 202 may be selected to activate a specific combination of resonance structures. For example, in some embodiments, feeding portion 202 may be configured to activate and couple together a parallel resonance element and a first serial resonance component when supplied with a radiofrequency signal in a first frequency range, and may be configured to activate and couple together the parallel resonance element and a second serial resonance component to radiate in a second frequency range. In such an embodiment, for example, a first frequency range may be a low-band frequency range and a second frequency range may be a high-band frequency range. Feeding portion 202 may enable a coupling element to provide coupling between multiple serial resonance components and at least one parallel resonance element due to unique structural elements, as discussed below with respect to FIG. 3. In some embodiments, the radiofrequency signal carried by the feeding portion 202 may also be selected to activate only a single resonance structure.

Figure 3:
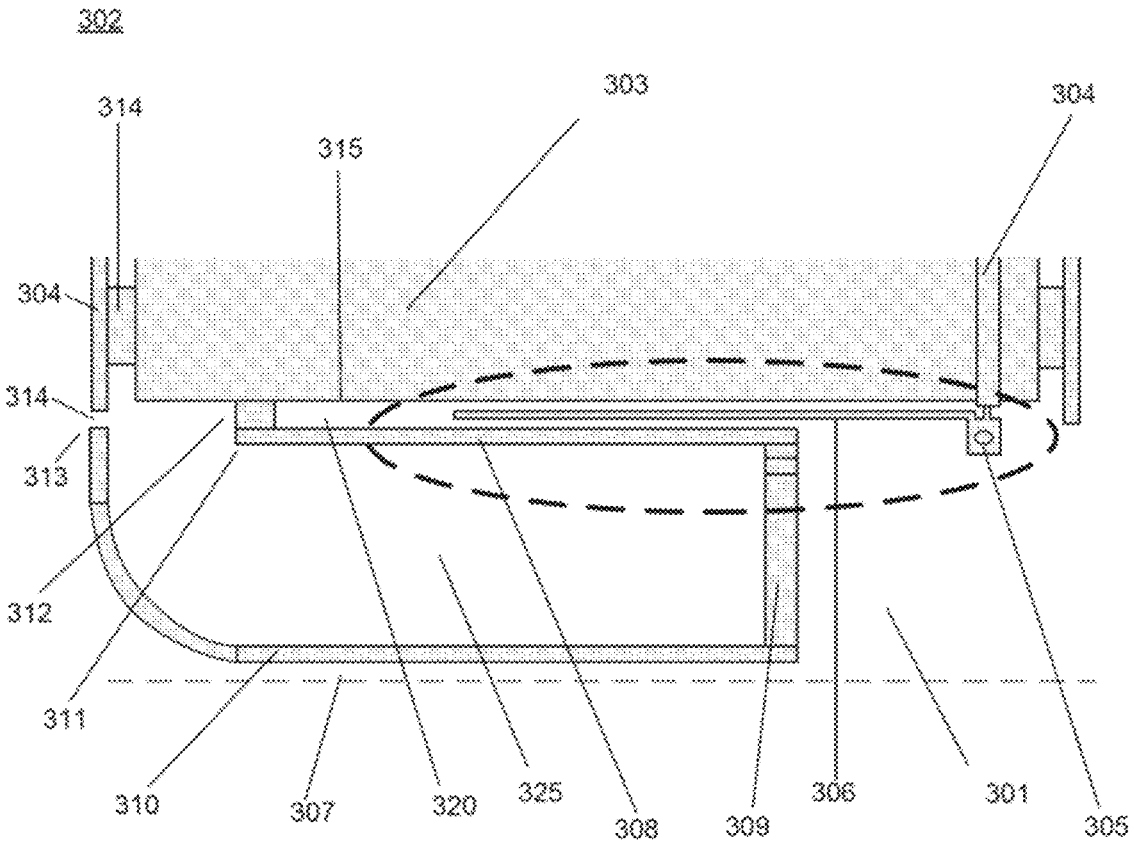
FIG. 3 is an illustration of an antenna consistent with the disclosure.
Figure 3:
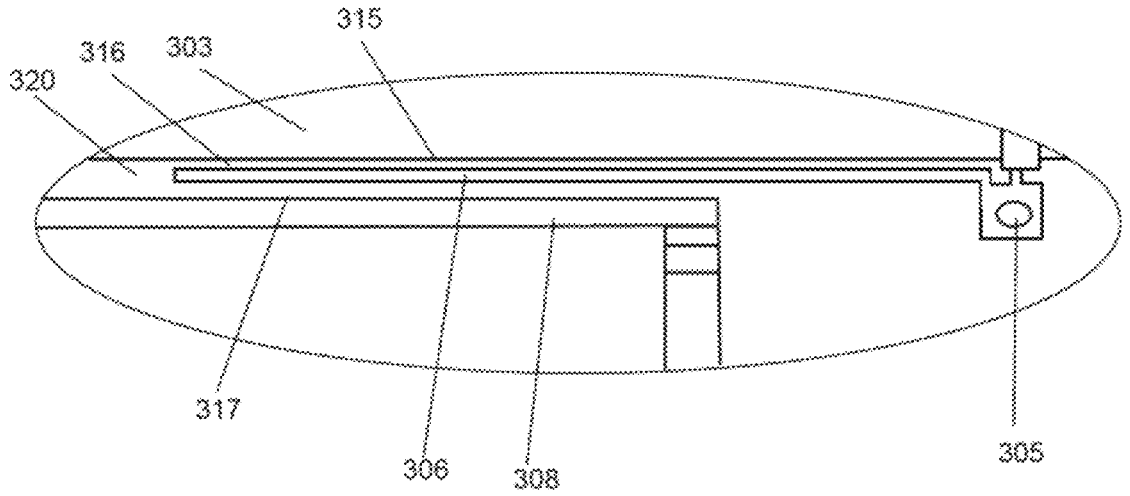

FIG. 3 illustrates a multi-band antenna 301, which may be modeled as a multi-coupled resonance circuit 200, for a wireless device 302. Wireless device 302 may include a device chassis 304, a portion of which is illustrated in FIG. 3. Device chassis 304 may form at least a portion of or an entirety of a housing of wireless device 302. Device chassis 304 may form an internal structure of a housing of wireless device 302. In some embodiments, device chassis 304 may include a conductive frame or conductive bezel surrounding a portion or an entirety of wireless device 302. Device chassis 304 may include conductive elements. Device chassis 304 may include conductive elements in galvanic communication with one another, and may include additional conductive elements not in galvanic communication with the entirety of device chassis 304. Device chassis 304 may be coupled, galvanically or otherwise, to other conductive elements of wireless device 302 to serve as at least a portion of a radiating antenna structure. For example, at least a portion of device chassis 304 may be configured to radiate as a parallel resonance element when activated with an appropriate frequency signal.

Wireless device 302 may include a counterpoise 303. Counterpoise 303 may be a conductive element forming at least a portion of a grounding region of antenna 301. Counterpoise 303 may be formed on a substrate and may be formed of various structures within wireless device 302. Counterpoise 303 may include ground edge 315. Ground edge 315 may be, as illustrated in FIG. 3, a substantially straight, elongated edge of counterpoise 303. In other embodiments, ground edge 315 may have a curved, wavy, labyrinthine, or other non-linear configuration. In some embodiments, ground edge 315 may have linear and non-linear portions. In some embodiments, counterpoise 303 may be galvanically connected to, i.e., at chassis ground connection 314, or may be a portion of device chassis 304. While FIG. 3 illustrates counterpoise 303 as a regular, elongated rectangle, counterpoise 303 may be formed of any suitable shape and size. In particular, counterpoise 303 may be configured to accommodate other components located within wireless device 302.

Counterpoise 303 may form at least a portion of a resonance structure of antenna 301. For example, counterpoise 303 may form at least a portion of a parallel resonance element. In some embodiments, device chassis 304 may include counterpoise 303 and may form at least a portion of a resonance structure.

Counterpoise 303 and wireless device chassis 304 may be configured to be of appropriate electrical lengths to form, each alone or together in combination, at least a portion of a resonance structure. As used herein, electrical length refers to the length of a feature as determined by the portion of a radiofrequency signal that it may accommodate. For example, a feature may have an electrical length of λ4 (e.g., a quarter wavelength) at a specific frequency. An electrical length of a feature may or may not correspond to a physical length of a structure, and may depend on radiofrequency signal current pathways. Features having electrical lengths that appropriately correspond to intended radiation frequencies may operate more efficiently.

Thus, a structural element of antenna 301 may be sized to be of an appropriate electrical length for a frequency range at which the structure is designed to radiate. For example, in an embodiment including a wireless device chassis 304 configured to function as at least a portion of a parallel resonance element, the wireless device chassis 304 may be sized at λ2 (e.g., a half-wave) at an intended activation frequency.

Antenna 301 may include a common conductive element 307. Common conductive element 307 may include a first elongate segment 308, a second elongate segment 309, and a third elongate segment 310. Common conductive element 307 may be configured with more or fewer segments, as may be implemented for specific applications. Common conductive element 307 may share physical structure with other elements of wireless device 302. For example, as illustrated in FIG. 3, third elongate segment 310 may form a portion of an external frame of wireless device 302, and thus may serve as a portion of device chassis 304. Common conductive element 307 may include a first end 311 and a second end 313. Common conductive element 307 may be coupled, galvanically, reactively (e.g., capacitively or inductively), or otherwise, at connection 312. Common conductive element 307 may be configured to as a folded monopole, folded around slot 325, which may be a window or space partially or completely surrounded by elongate segments of folded common conductive element 307. Thus common conductive element 307 may define slot 325.

Common conductive element 307 may be located so as to form slit 320 between a portion of common conductive element 307 and ground edge 315. Slit 320 may be an elongated slit or gap between common conductive element 307 and ground edge 315. Slit 320 may be an element of coupling portion 104 in multi-coupled resonance circuit 201. The width and length of slit 320 may be varied based on a frequency of operation of a wireless device, for example slit 320 may be between 30 and 45 mm long, and/or may have an electrical length of between 0.06λ and 0.405λ at frequencies between 600 MHz and 2.7 GHz. The width of slit 320 may be between 0.2 and 2 mm and have an electrical length between 0.0004λ and 0.018λ.

Antenna 301 may further include a feeding portion 204 including several elements. Feeding portion 204 may include feed line 306 configured to carry a radiofrequency signal from processing elements of wireless device 301 to a feedpoint 305. Distributed feed element 306 may be coupled, galvanically, reactively, or otherwise, to feedpoint 305. Distributed feed element 306 is pictured in greater detail in the inset image of FIG. 3. Distributed feed element 306 may be located in proximity to slit 320 and may be located so as to define a first gap 316 between distributed feed element 306 and ground edge 315 and a second gap 317 between distributed feed element 306 and common conductive element 307. First gap 316 and second gap 317 may each have a smaller physical width than slit 320. Although distributed feed element 306 may be located in a same plane as ground edge 315 and common conductive element 307, it is not required, and distributed feed element 306 may be located offset from these features. Slit 320, first gap 316, and second gap 317 may be partially or completely filled by a dielectric material, such as air, plastic, Teflon, or other dielectric. Feed element 306 may be separated from common conductive element 307 by a distance in the range of approximately 0.2-1 mm, corresponding to an electrical distance in the range of approximately 0.000λ-0.009λ, where λ is a wavelength corresponding to at least one frequency at which antenna 301 may radiate. Feed element 306 may have a width of electrical length between approximately 0.0004λ and 0.009λ, or between approximately 0.002-0.0135λ. In some embodiments, feed element 306 may have a width in the range 0.2-1 mm.

Figure 4A:
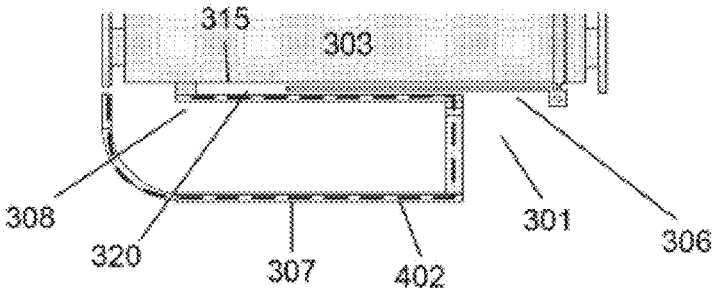
FIGS. 4*a*-4*d* illustrate the operation of an antenna consistent with the disclosure.

When provided with a radiofrequency signal via feed line 306 antenna 301 may operate as follows, as described with respect to FIGS. 4*a*-4*c*. FIG. 4*a* illustrates a representative current pathway 402 of a low-band (e.g., between approximately 600 MHz-1000 MHz) signal in common conductive element 307. Representative current pathway 402 is illustrative only, as a person of skill in the art will recognize that current pathways may differ from that illustrated without departing from the concepts disclosed herein. In the embodiment illustrated in FIG. 4*a*, common conductive element 307 may operate as a first serial resonance component, receive current via coupling with distributed feed element 306, and radiate as a quarter wave monopole in the activated frequency range. Device chassis 304 may operate as a parallel resonance element, radiating as a half wavelength element in the activated frequency range. A coupling element, including at least distributed feed element 306, ground edge 315, first elongate segment 308, and slit 320 may be formed between the first serial resonance component at least partially formed by common conductive element 307 and a parallel resonance element at least partially formed by device chassis 304. Thus, this structure may function as a coupled resonance circuit 100. As discussed above, this structure, modeled as coupled resonance circuit 100, may have a wide bandwidth due substantially to properties of a parallel resonance element at least partially formed by device chassis 304 functioning as a parallel resonance circuit 102 while having an effective frequency range due substantially to properties of both the serial resonance component at least partially formed by common conductive element 307 functioning as a serial resonance circuit 103 and the parallel resonance element at least partially formed by device chassis 304.

Multi-band properties of antenna 301 may be achieved through the dual function of common conductive element 307 as a serial resonance component in a high band frequency range (e.g., approximately 1.7-2.76 GHz). When activated with a radiofrequency in this higher frequency range, the structure defined by common conductive element 307 and slot 325 may radiate as a quarter wavelength slot antenna, with representative slot antenna current pathway 403 as illustrated in FIG. 4*b*. Thus, in operation, antenna 301 may exhibit multi-band properties, radiating in multiple frequency ranges. Common conductive element 307 may form at least a portion of a first serial resonance component configured to radiate at a first frequency, and may form at least a portion of a second serial resonance component configured to radiate at a second frequency different than the first frequency. Either or both of the first and second serial resonance components so defined may be configured to couple to the parallel resonance element (formed at least partially by device chassis 304) through a coupling element at least partially formed by distributed feed element 306.

Figure 4B:
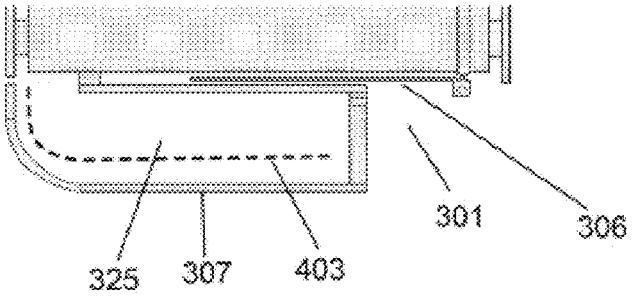
Figure 4C:
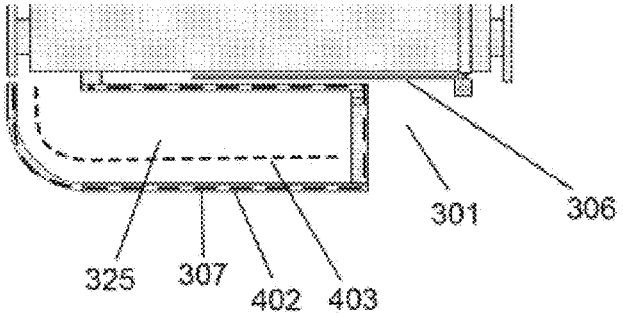
Figure 4D:
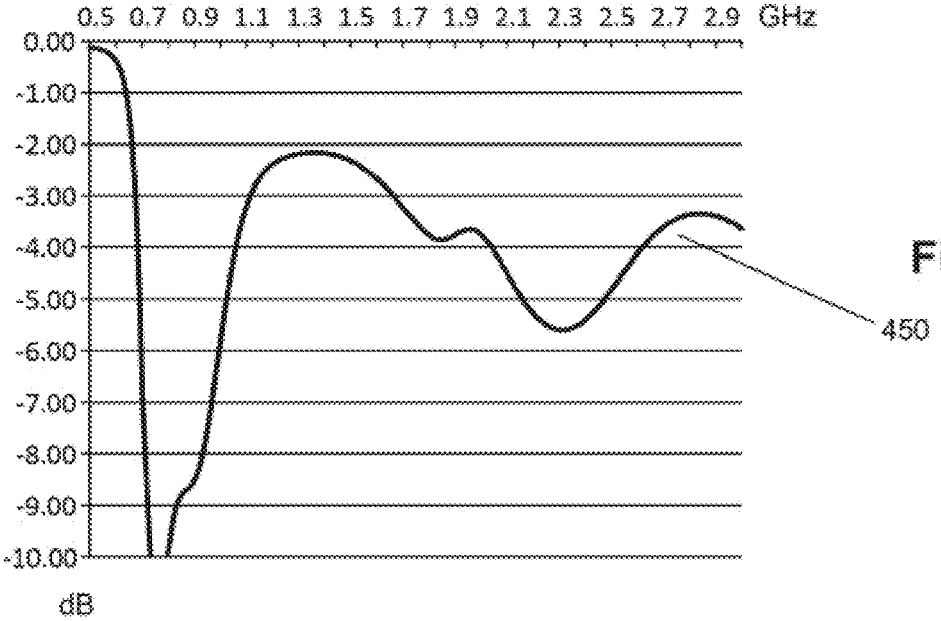

An exemplary graph of the multiband performance of antenna 301 as illustrated in FIGS. 4*a*-4*c* is shown in FIG. 4*d*. FIG. 4*d* illustrates an exemplary return loss graph 450 of antenna 301 in a frequency range between 500 MHz and 3 GHz. As illustrated in FIG. 4*d*, antenna 301 exhibits resonances at 800 MHz and 2.3 GHz, which permit antenna 301 to effectively radiate as a multi-band antenna. While antenna 301, as illustrated, exhibits multi-band performance in the 800 MHz and 2.3 GHz band, it is understood that these frequency bands may be altered or tuned based on properties of the antenna without departing from the concepts disclosed herein.

The achievement of multi-band performance and the dual radiation function of common conductive element 307 may be at least partially attributed the folded nature of common conductive element 307 and to the nature of distributed feed element 306.

First, in order to radiate as a quarter wave monopole at two different frequency ranges, common conductive element 307 may define radiating structures having two different electrical lengths corresponding to the frequency ranges. These two electrical lengths may be achieved by establishing two alternate current pathways 402, 403. As illustrated in FIG. 4*c*, first current pathway 402 may have an electrical length determined substantially by an overall length of radiating element 307, while second current pathway 403 may have an electrical length determined substantially by a length of slot 325 as defined by a fold in common conductive element 307. The establishment of two current pathways having different electrical lengths permits radiation in two frequency ranges.

Second, in order to radiate as a quarter wave monopole at two different frequency ranges, the monopole may use two different feed points. In conventional quarter wave monopole designs, an antenna may be fed at a feed location on one end, and the feedline may be sized to deliver a radiofrequency signal having appropriate current characteristics at the feedpoint. Such a design may, however, may face significant performance drops when supplied with a radiofrequency signal outside of the design frequency. Distributed feed element 306 may address this issue by providing a range of potential feeding locations throughout its length. In operation, radiofrequency signals of different frequencies (and different wavelengths) may therefore couple from distributed feed element 306 to common conductive element 307 at different points along the portion of distributed feed element 306 located in proximity to common conductive element 307.

FIGS. 3 and 4*a*-4*d* illustrate one particular physical embodiment of the coupled resonance circuit concepts described by this disclosure. Alternative physical embodiments may be designed and implemented to achieve an antenna with various parameters without departing from the spirit and scope of this disclosure. FIGS. 5-9 disclose additional embodiments consistent with the present disclosure.

Figure 5A:
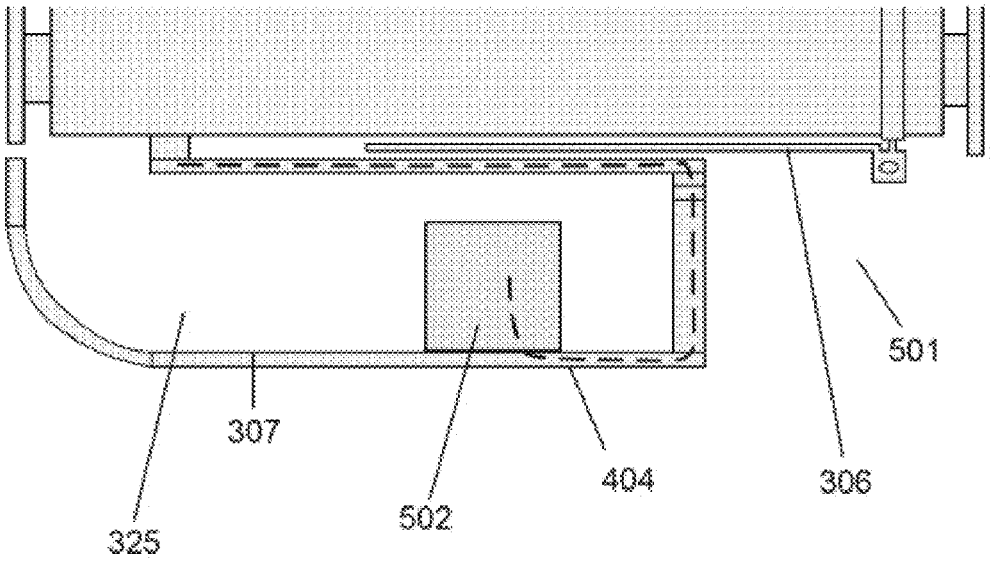
FIGS. 5*a*-5*b* illustrate the operation of an antenna consistent with the disclosure.

FIG. 5*a* illustrates an antenna 501 consistent with the present disclosure. Antenna 501 includes conductive protrusion 502, which may assist in establishing an additional serial resonance component, illustrated by representative current path 404. In some embodiments, conductive protrusion 502 may be formed at least partially from a power connector of wireless device 302. The additional serial resonance component illustrated in FIG. 5*a* may operate as a quarter wave monopole in the high frequency band of the antenna, and may function to improve the coupling to distributed feed element 306 and/or improve the bandwidth in the high-frequency range. Improved coupling can be seen in the return loss graph 550 of antenna 501, illustrated in black in FIG. 5*b*, as compared to return loss graph 450 of antenna 301, illustrated in gray in FIG. 5*b*. Return loss graph 550 displays an improved return loss response in the high-frequency range.

Figure 5B:
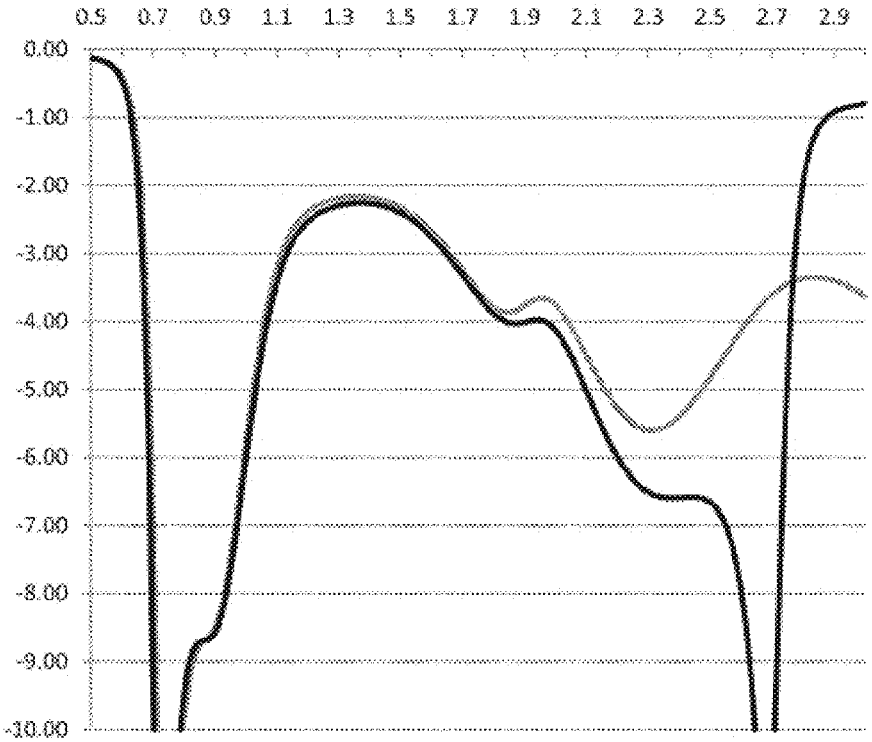

In the embodiment of FIGS. 5*a*-5*b*, serial resonance components illustrated by representative current pathway 402 and representative slot antenna current pathway 403 may still operate when distributed feed element 306 provides the appropriate activation frequency. Thus, FIG. 5*a* illustrates an antenna 501 wherein common conductive element 307 functions as at least a portion of three different serial resonance components, each resonant at a different frequency.

Figure 6A:
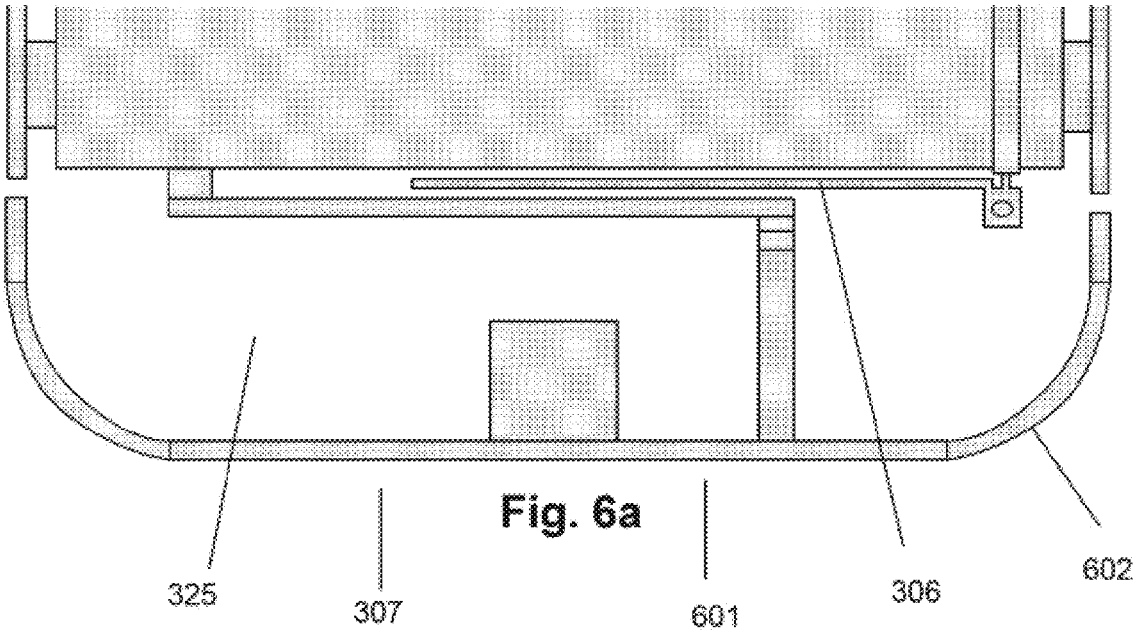
FIGS. 6*a*-6*b* illustrate the operation of an antenna consistent with the disclosure.
Figure 6B:
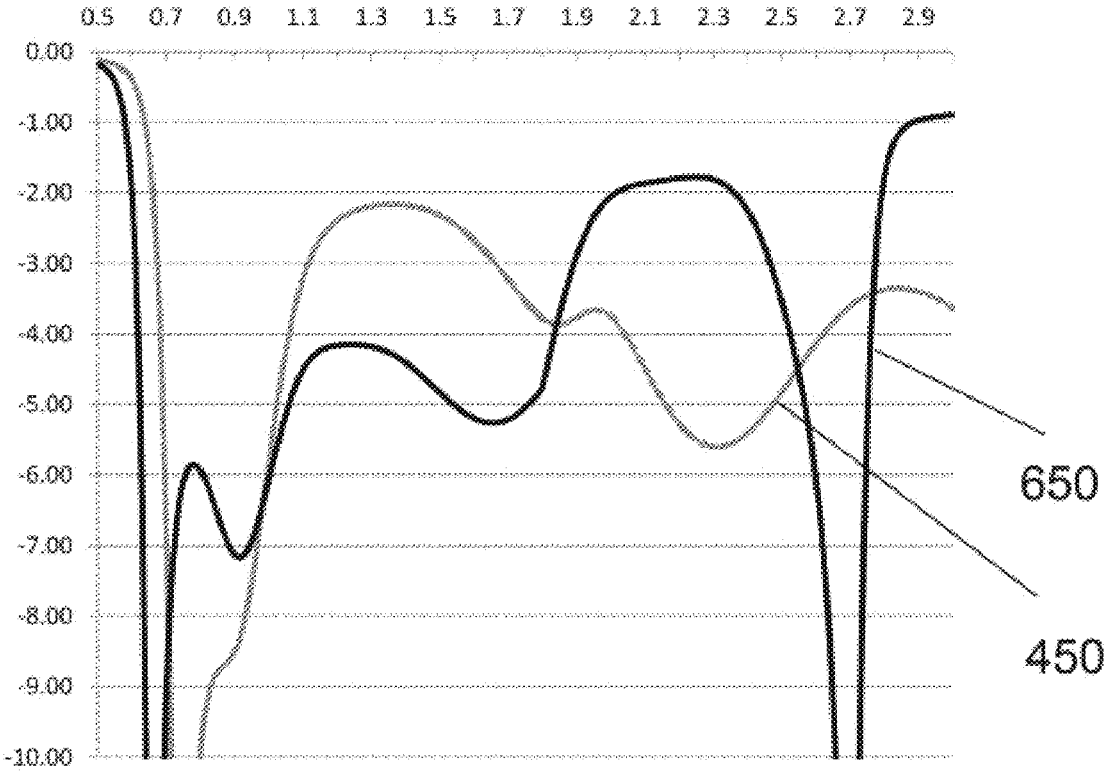

FIG. 6*a* illustrates an antenna 601 consistent with the present disclosure. Antenna 601 includes conductive spur 602. The addition of conductive spur 602 may function to improve antenna coupling in the low frequency range, as illustrated in FIG. 5*b*. Improved coupling can be seen in the low frequency range in return loss graph 650 of antenna 601, as compared to return loss graph 450 of antenna 301, illustrated in gray in FIG. 5*b*. In the embodiment shown in FIGS. 6*a*-6*b*, serial resonance components illustrated by representative current pathway 402, 403, 404 (as shown in FIGS. 4*c* and 5*a*) may still operate when distributed feed element 306 provides the appropriate activation frequency.

Figure 7A:
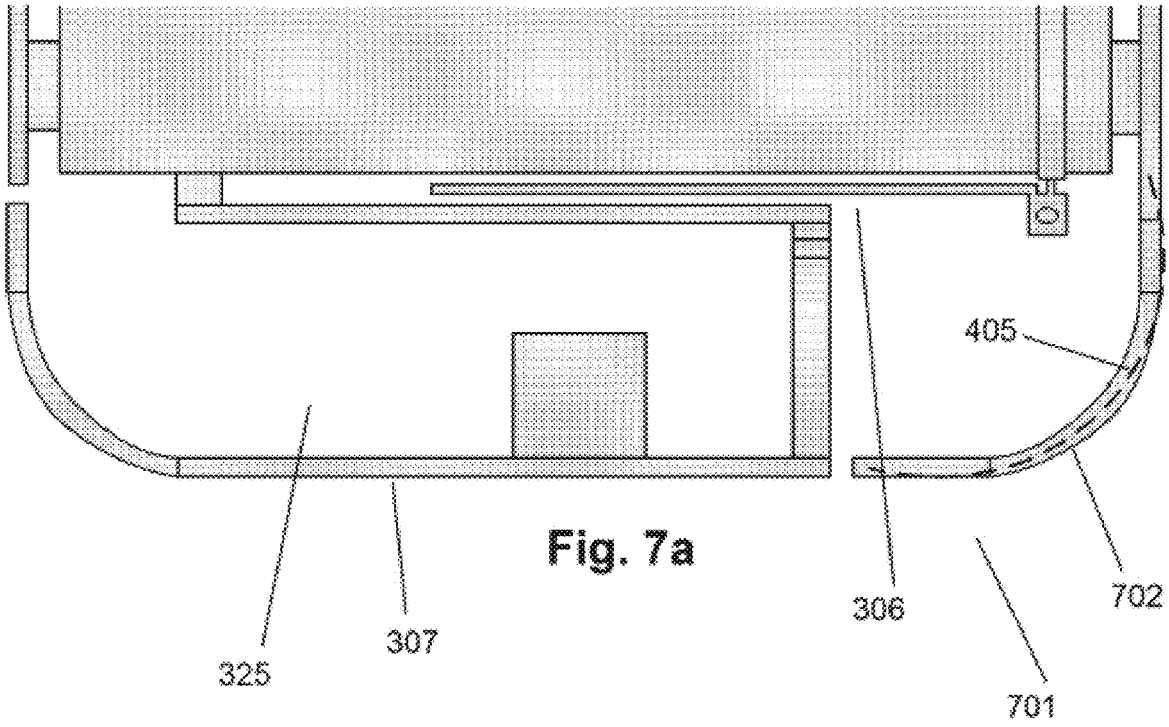
FIGS. 7*a*-7*b* illustrate the operation of an antenna consistent with the disclosure.
Figure 7B:
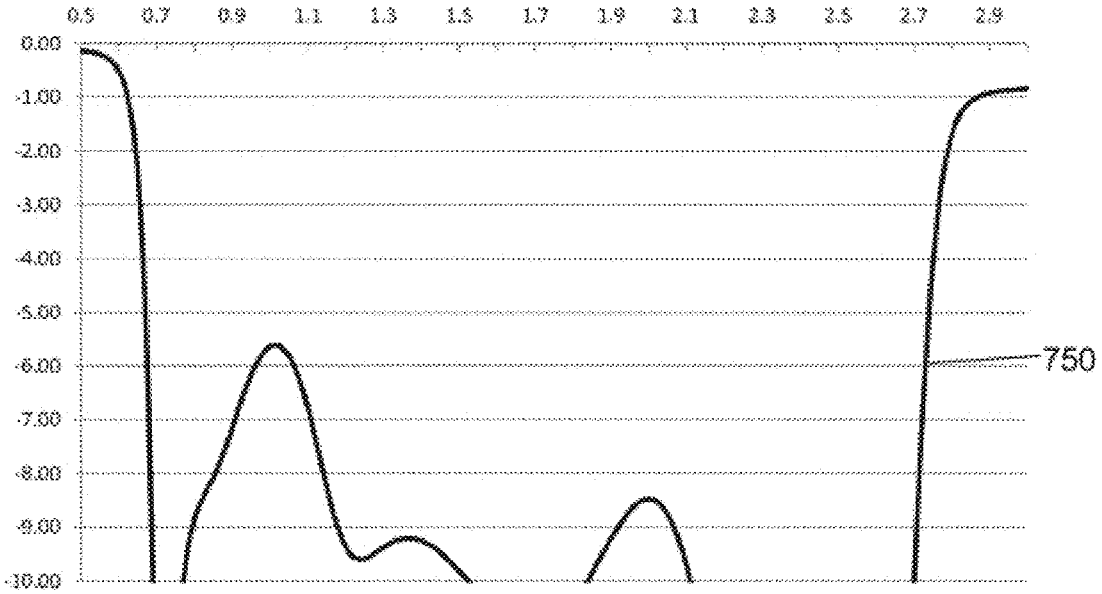

FIG. 7*a* illustrates an antenna 701 consistent with the present disclosure. Antenna 701 may include spur element 702, which may function as a parasitic element, coupling at a frequency intermediate between the low-band and high-band frequencies. The current in spur element 702 may be illustrated by representative current path 405. Spur element 702 may be configured as a quarter wavelength parasitic element in the intermediate frequency band. Improved antenna bandwidth can be seen in the return loss graph 750 of antenna 701, illustrated in FIG. 7*b*. Return loss graph 750 displays an improved return loss response over significant portions of the multi-band frequency range. In the embodiment shown in FIGS. 7*a*-7*b*, serial resonance circuits 103 illustrated by representative current pathways 402, 403, and 404 may still operate when distributed feed element 306 provides the appropriate activation frequency. Thus, FIG. 7*a* illustrates an antenna 701 including multiple coupling paths and methods.

Figure 8A:
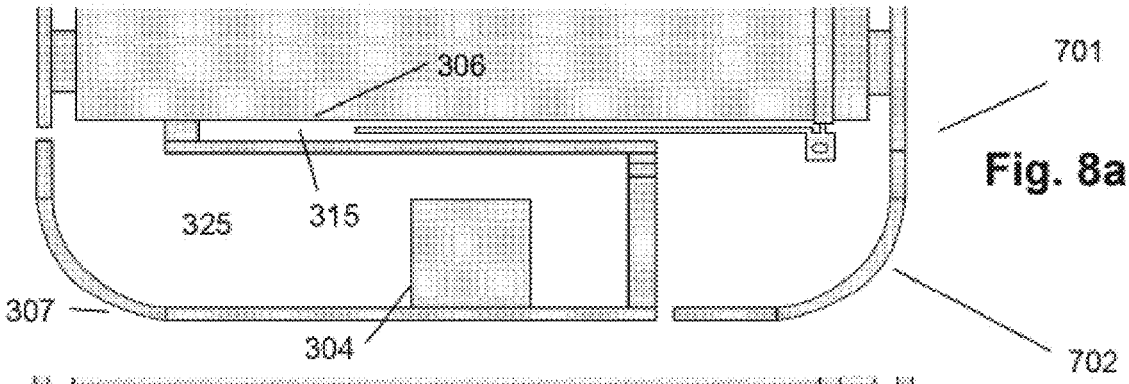
FIGS. 8*a*-8*d* illustrate the operation of an antenna consistent with the disclosure.
Figure 8B:
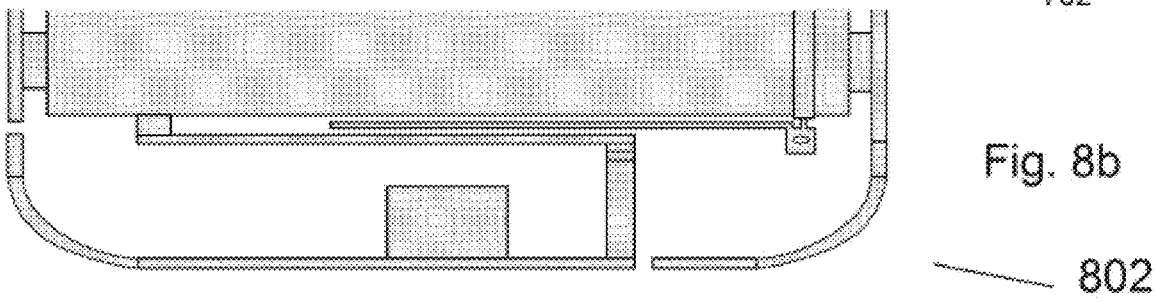
Figure 8C:
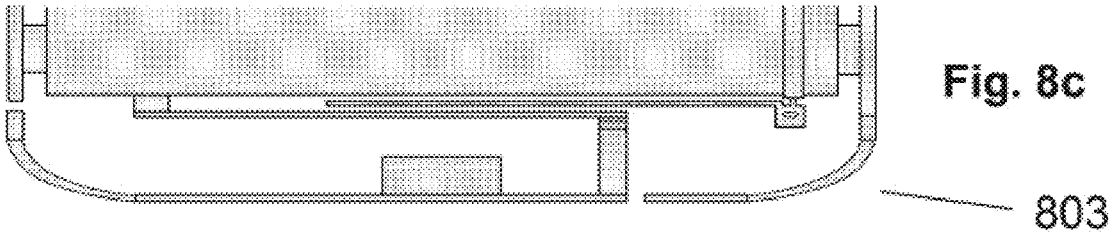
Figure 8D:
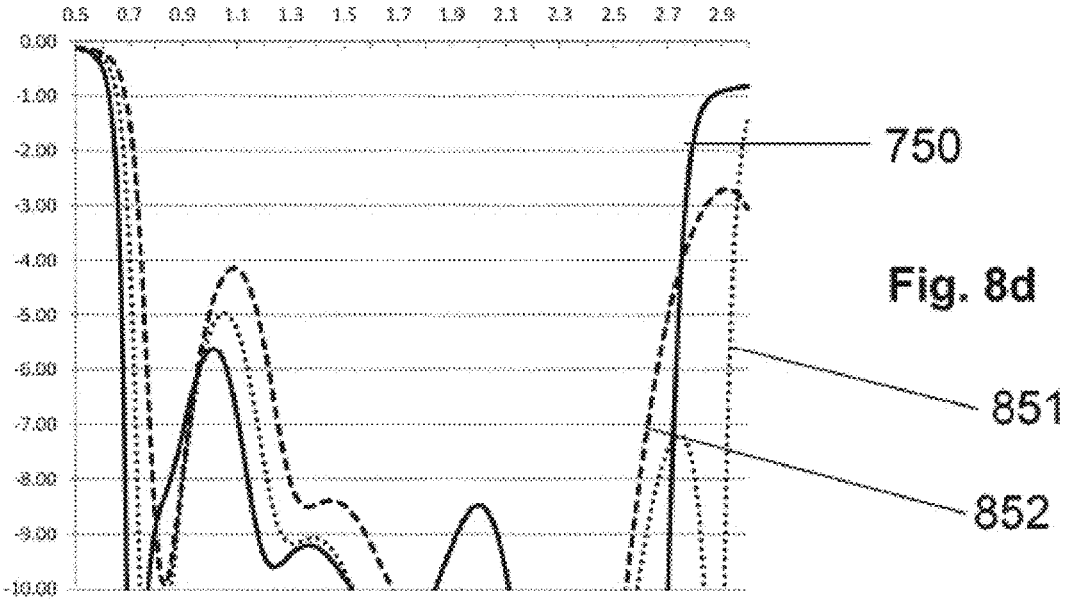

FIGS. 8*a*-8*d* illustrate differences between a series of antennas consistent with the present disclosure. FIG. 8*a* illustrates antenna 701, also shown in FIG. 7*a*. FIG. 8*b* illustrates the return loss graph 750 of antenna 701, also shown in FIG. 7*b*. FIGS. 8*b* and 8*c* illustrate antennas 802 and 803, each of which is a design variant of antenna 701. In antenna 802, illustrated in FIG. 8*b*, a distance between ground plane edge 315 and a portion of common conductive element 307 that shares structure with device chassis 304 is reduced. In antenna 803, illustrated in FIG. 8*c*, the distance is reduced again. In antenna 802, the distance between ground plane edge 315 and a portion of common conductive element 307 that shares structure with device chassis 304 is reduced by approximately 2.5 mm, and, in antenna 803, the distance is reduced by 5 mm. As seen in FIG. 8*d*, these size reductions may shift the resonant frequencies of antennas 802 and 803 to higher frequencies, but do not have significant effects on the overall bandwidth of the antennas. This demonstrates that the bandwidth, related to the Q factor of the antenna, is substantially determined by the resonance structure having the lowest Q factor. In antennas 701, 802, 803, the lowest Q factor is demonstrated by the parallel resonance element including counterpoise 303. The alteration in Q factor caused by the antenna variations illustrated in FIGS. 8*a*-*c* may not substantially alter the bandwidth of the resulting antennas.

Figure 9A:
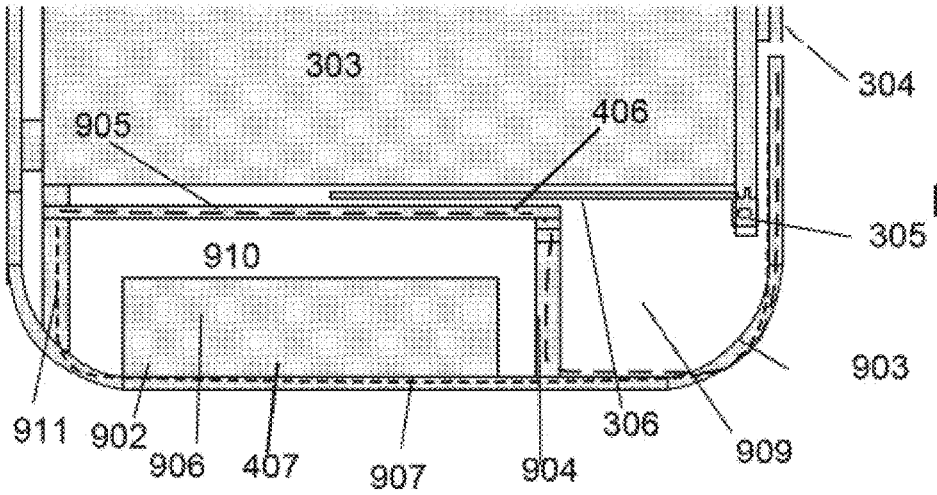
FIGS. 9*a*-9*c* illustrate the operation of an antenna consistent with the disclosure.
Figure 9B:
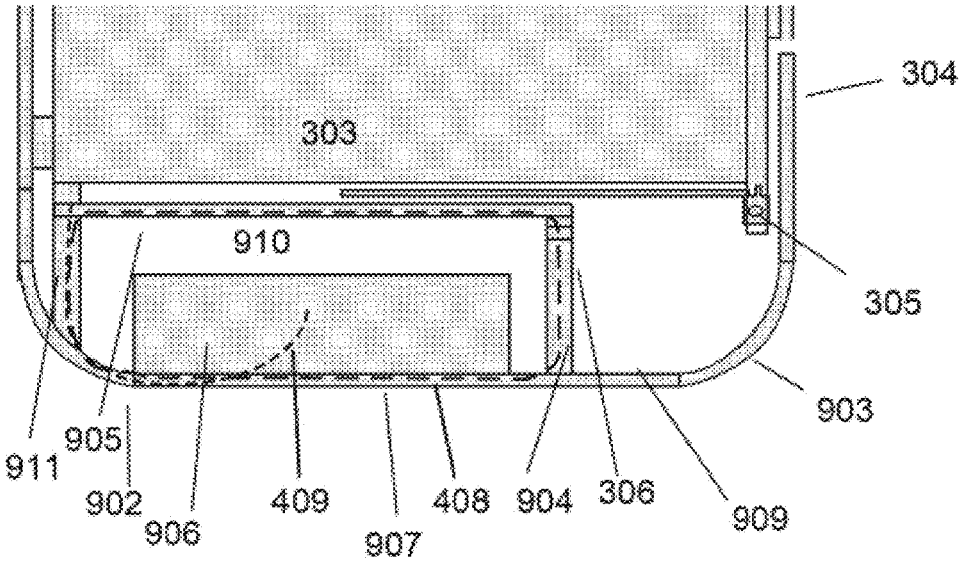

FIG. 9*a* illustrates an alternative antenna 901 designed as a multi-coupling resonance structure functioning as a multi-coupled resonance circuit 200 and consistent with the present disclosure. Antenna 901 may include a counterpoise 303 having a ground edge 315, a device chassis 304, a feed point 305, a distributed feed element 306, and a radiating element 907. Radiating element 907 may include a first branch 903, a second branch 902, a connection portion 904, a base portion 905, an extension 906, and a loop portion 911. Radiating element 907 may further define slot 910 and slot 909, each of which may be filled by a dielectric material.

Operating at low-band frequencies, antenna 901 may include a parallel resonance element, formed from at least a portion of counterpoise 303 and/or wireless device chassis 304. The parallel resonance element may couple through a coupling element at least partially formed by distributed feed 306 to either one of a pair of serial resonance components. The coupling element may include base portion 905 of radiating element 907, ground edge 315, and distributed feed element 306. A first serial resonance component of antenna 901 may include a current pathway 406 as illustrated in FIG. 9*a*. As illustrated, current pathway 406 of a first serial resonance circuit 103 may extend along radiating element 907, starting from base portion 905 and extending through connecting portion 904 to first branch 903. The antenna structure defined by current pathway 406 may operate as a quarter wave monopole in a low-frequency band. A second serial resonance component of antenna 901 may include current pathway 407 as illustrated in FIG. 9*a*. As illustrated, current pathway 407 of a second serial resonance component may extend along radiating element 907, starting from loop portion 911 and extending through second branch 902 to first branch 903. The antenna structure defined by current pathway 407 may operate as a quarter wave monopole in a low-frequency band.

Figure 9C:
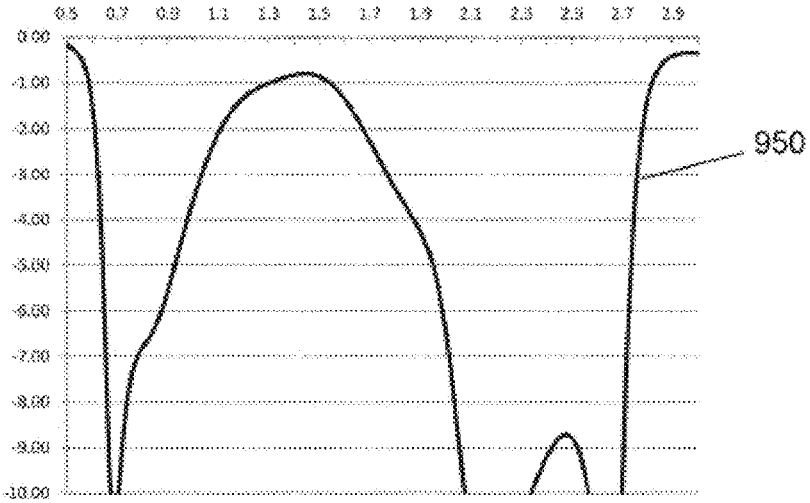

Operating at high-band frequencies, antenna 901 may also include a plurality of serial resonance components. A first high-band serial resonance component may include looped current pathway 408, traveling around base portion 905, connection portion 904, second branch 902, and loop portion 911. A second high-band serial resonance component may include current pathway 409, traveling through loop portion 911 and into extension 906. High-band performance may be further augmented by harmonics of the low-band radiating structures. For example, a low-band radiating structure, having current pathway 406 or 407, may be configured to resonate at approximately 700 MHz. In such a case, the structure may also radiate at a third harmonic, at approximately 2.1 GHz. The performance of antenna 901 is illustrated by return loss graph 950, as shown in FIG. 9*c*.

Figure 10A:
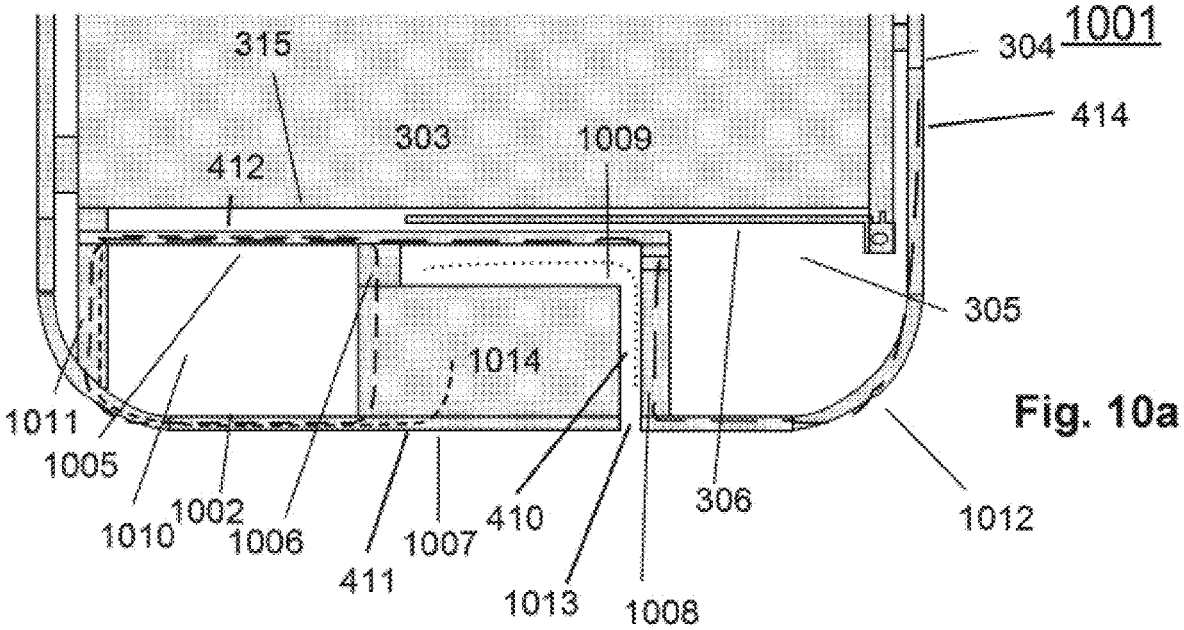
FIGS. 10*a*-10*b* illustrate the operation of an antenna consistent with the disclosure.
Figure 10B:
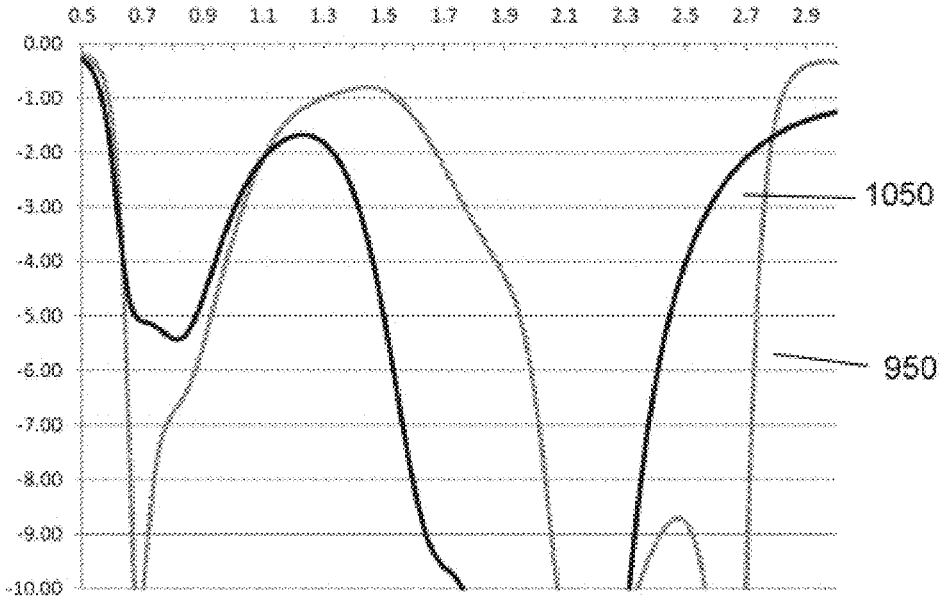

FIGS. 10*a* and 10*b* illustrate the structure and performance of another antenna variant, antenna 1001, consistent with the present disclosure. Antenna 1001 may include device chassis 304, counterpoise 303 having ground edge 315, radiating element 1007 having base portion 1005, first connecting portion 1006, first branch 1002, extension 1014, loop portion 1011, second connecting portion 1008, and second branch 1012. The structural portions of radiating element 1007 may further define slot 1010, slot 1009, and gap 1013, each of which may be filled with dielectric material.

Antenna 1001 may be considered a variation of antenna 901. In the low-band frequency ranges, antenna 1001 may include a serial resonance component having a current pathway 414 that extends from base portion 1005, across second connecting portion 1008, and along second branch 1012. This pathway is similar to current pathway 406 of antenna 901. The addition of slot 1013 may eliminate a current pathway similar to current pathway 407 of antenna 901, leaving just one low-band frequency current pathway 406 which may follow base portion 1005, second connecting portion 1008, and second branch 1012. The slot 1013, however, may also permit an additional serial resonance component in the high-band frequency ranges by creating current pathway 410 in slot 1009, which may function as a quarter wave slot antenna.

Current pathways 411 and 412 may define additional serial resonance components, operating similarly to current pathways 409 and 408, respectively. As illustrated in return loss graph 1050 of antenna 1001 as compared to return loss graph 950 of antenna 901 in FIG. 10*b*, antenna 1001 demonstrates a wider bandwidth in the high-frequency ranges. The additional structural changes shown do not significantly affect the low frequency bandwidth of antenna 1001, although the strength of the resonance appears to be reduced. In some embodiments, an inductive circuit element, acting as a short circuit at low frequencies and as an open circuit at high frequencies, may be arranged to bridge gap 1013. The addition of such an inductive circuit element may create an additional low band current pathway similar to current pathway 407 and may serve to increase the strength of the low band resonance in antenna 1001.

Any of the above-described antennas may be combined with other such antennas in a single device to implement a multi-input multi-output (MIMO) antenna and provide for MIMO communications. In general, MIMO antennas and associated communication devices multiply the capacity of a wireless communication link by using multiple antenna structures that are configured to work together to exploit multipath propagation techniques. For example, a MIMO antenna with two antenna structures can transmit double the data throughput using MIMO communication techniques compared to a single antenna. These MIMO antennas and multipath propagation techniques thus can facilitate the simultaneous sending and/or receiving of more than one data signal on the same frequencies via multipath propagation.

In general, MIMO antennas in accordance with the embodiments described herein are implemented to include multiple antenna structures, where the multiple antenna structures share a common radiating element in a way that facilitates MIMO operation. In some embodiments the shared radiating element comprises a shared antenna counterpoise. Furthermore, in some of these embodiments the shared radiating element is formed from the chassis of an associated wireless communication device.

To provide effective MIMO communication, the multiple antenna structures are configured in a way that reduces coupling between the antenna structures. Specifically, the antenna structures are configured to reduce coupling in the shared radiating element (e.g., shared chassis or counterpoise used as a shared radiating element). Reducing the coupling between antenna structures reduces interference, and thus can improve usable bandwidth and MIMO communication functionality.

For example, the coupling between antenna structures that share a radiating element can be reduced in some embodiments using the relative spacing of the antenna structures and the shared radiating element. In other embodiments the shape and structure of the radiating element is configured to reduce coupling between antenna elements. For example, projecting structures that extend from a surface of the radiating element can be used to reduce coupling.

A variety of different types and configurations of antenna structures can be used in such MIMO antennas. For example, the various antennas described above can be implemented with a shared radiating structure to provide MIMO communication. As one specific example, each antenna structure in the MIMO antenna can include a first parallel resonance element configured to resonate in at least one frequency, a first serial resonance component configured to resonate at a first frequency and configured to couple to the first parallel resonance element, and a first distributed feed element connected to a first feed line and configured to deliver a radiofrequency signal and couple to the first parallel resonance element and first serial resonance component at the first frequency. In a typical implementation multiple of such antenna structures can be configured together with a shared radiating element to provide MIMO communication. Specifically, in some embodiments the parallel resonance elements of the multiple antenna structures can each be at least partially defined by a counterpoise that functions as a shared radiating element.

As another specific example, the MIMO antenna can be provided that uses a shared conductive chassis as a radiating element. In such an embodiment the multiple antenna structures implemented to share the conductive chassis as a radiating element can each include a conductive coupling element having one end connected to the conductive chassis, where the conductive coupling element and the conductive chassis cooperating to form a first slit therebetween, and an elongate feed element disposed at least partially in the slit between the coupling element and the conductive chassis.

Figure 11:
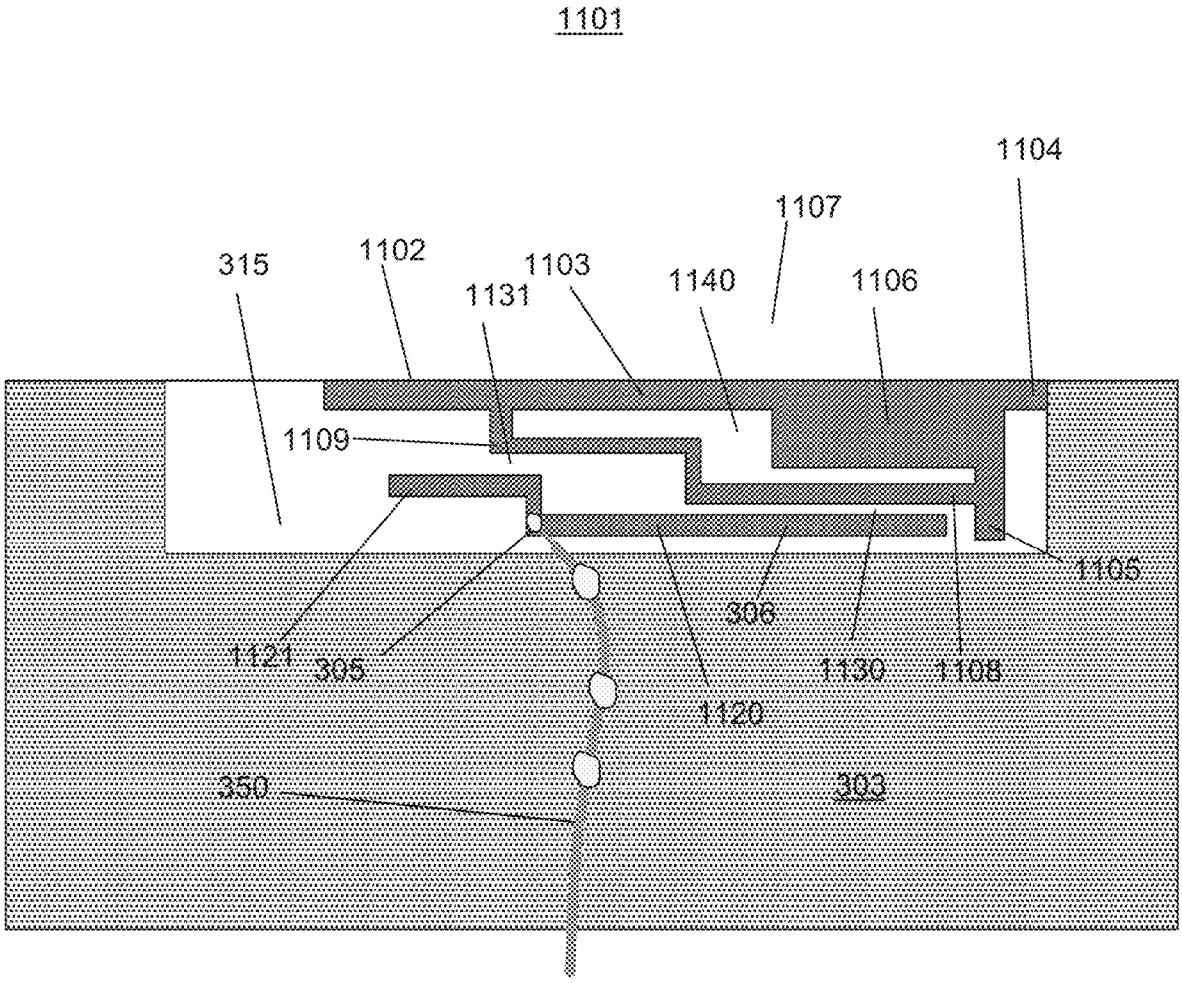
FIG. 11 illustrates the structure of an antenna consistent with the present disclosure.

FIG. 11 illustrates an example antenna structure 1101 designed as a multi-coupling resonance structure functioning as a multi-coupled resonance circuit 200 and consistent with the present disclosure. Specifically, antenna structure 1101 is an example of the type of antenna structure that can be used with other such antennas in a MIMO antenna device.

Antenna structure 1101 as illustrated includes a counterpoise 303 having a ground edge 315, a feed point 305, a feed line 350, a distributed feed element 306, and a radiating element 1107. The feed line 350 is suitably coupled (e.g., soldered) to the feed point 305 and the counterpoise 303. For example, the feed line 350 can comprise a coaxial cable, with the center conductor of the feed line 350 soldered to the feed point 305 and the conductive outer shield soldered to the counterpoise 303. Distributed feed element 306 may have a first branch 1120 and a second branch 1121. Radiating element 1107 may include a loop portion 1103, an extension 1102, a first connection portion 1104, a second connection portion 1105, and a central portion 1106. Loop portion 1107 may include a first coupling portion 1108 and a second coupling portion 1109. Radiating element 1107 may cooperate with distributed feed element 306 to form at least one slit, including, for example, first slit 1130 and second slit 1131. Loop portion 1107 may also define a slot 1140.

To facilitate operating at low-band frequencies, the antenna structure 1101 may include a parallel resonance element, formed from at least a portion of counterpoise 303 and/or a wireless device chassis (not shown). Such a parallel resonance element may couple through a coupling element at least partially formed by distributed feed 306 to serial resonance components formed by radiating element 1107. The coupling element may include either or both of first and second coupling portions 1108 and 1109, ground edge 315, and either or both of first branch 1120 and second branch 1121 of distributed feed element 306.

When configured to operate at relatively high-band frequencies, antenna structure 1101 may also include a plurality of serial resonance components formed from portions of radiating element 1107 and configured to couple through a coupling element to a parallel resonance element formed at least partially from counterpoise 303 and/or a wireless device chassis. As one specific example, low-band radiating structures consistent with antenna structure 1101 may be configured to resonate in a frequency band between 550 and 1000 MHz. Likewise, high band radiating structures consistent with the antenna structure 1101 may be configured to resonate in a frequency band between 1700 and 2700 MHz.

Figure 12:
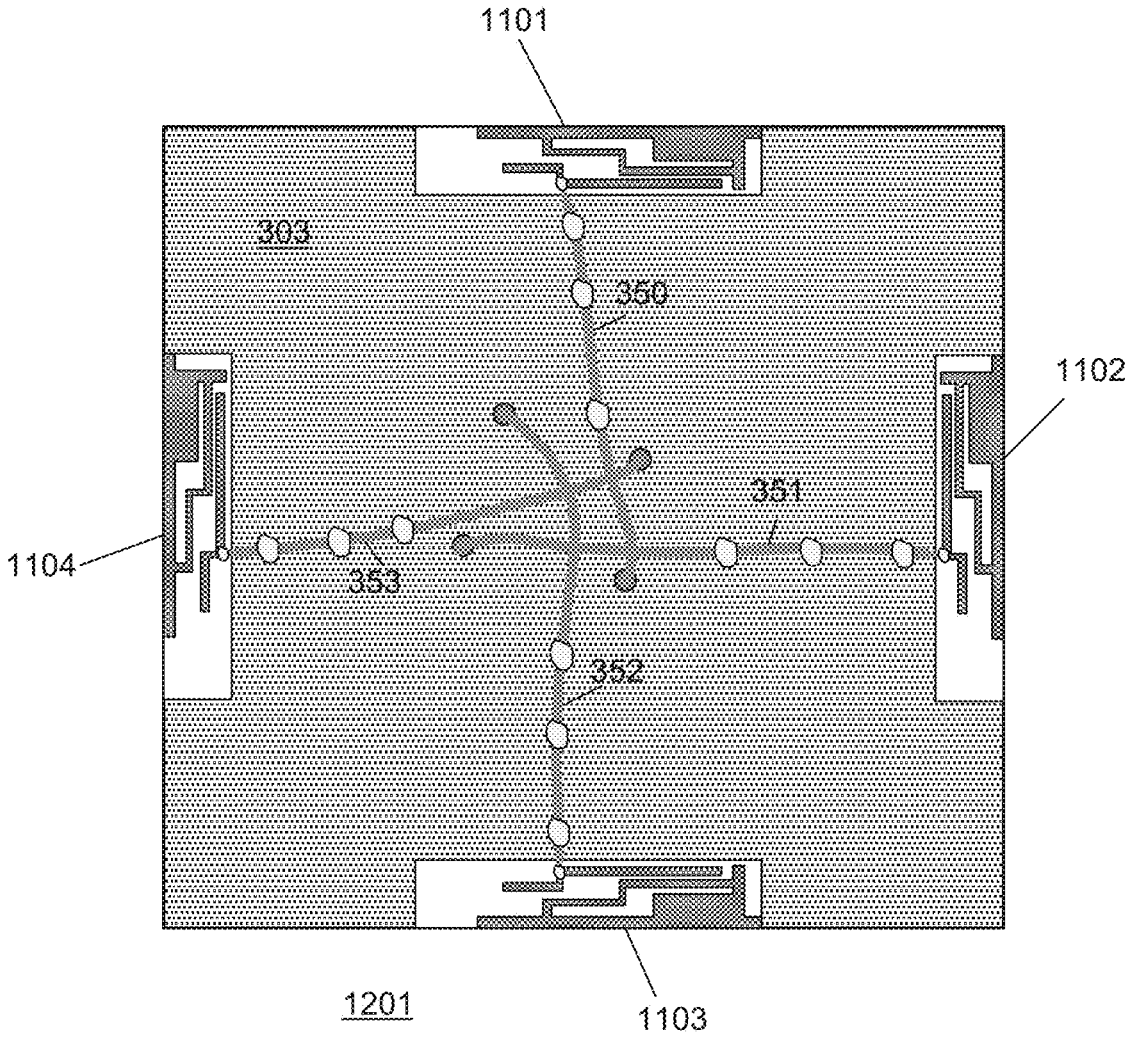
FIG. 12 illustrates the structure of a multiple-input multiple-output antenna consistent with the present disclosure.

In some embodiments, antenna structure 1101 may share counterpoise 303 and a device chassis with one or more other, similar antennas structures 1102, 1103, 1104 to function as a MIMO antenna 1201. An example of such an embodiment is illustrated in FIG. 12. In the example of FIG. 12 the antenna structures 1102, 1103, 1104 may have elements and structures similar to those of antenna structure 1101, as described above. In some embodiments, elements and structures of antenna structures 1102, 1103, 1104 may be substantially identical to that of antenna structure 1101. As used herein, substantially identical may refer to antenna structures that are designed with elements and components of the same sizes and in the same layouts in order to produce substantially similar performance. Such structures may vary slightly from each other in size and layout in a manner that does not significantly affect performance. In some embodiments, elements and structures of antennas structure 1102, 1103, 1104 may differ from each other in significant ways in order to achieve desirable end results.

In FIG. 12, the four antenna structures 1101, 1102, 1103, 1104 are configured to function together as a MIMO antenna 1201. It should be noted that four antenna structures are just one example, and that other numbers of antenna structures can be included in such a MIMO antenna. In the MIMO antenna 1201 each of the four antenna structures is coupled to separate feed line (e.g., feed lines 350, 351, 352 and 353) to transmit and receive signals separately from the other antenna structures.

In the example of FIG. 12, the spacing of the four antenna structures around the counterpoise 303 is selected to minimize coupling between antenna structures and thus improve MIMO performance. Specifically, the four antenna structures are spaced on opposite sides of the MIMO antenna 1201. This increases the distance between each of the antenna structures. Furthermore, adjacent antenna structures are positioned to be arranged different directions (e.g., with feed elements in horizontal vs vertical directions). The result of this configuration is to reduce coupling between antenna structures. Specifically, by reducing the amplitude of currents generated in the counterpoise 303, specifically, those currents that are near other of the four antenna structures. Thus, currents generated by one antenna structure have relatively low amplitude in those areas of the counterpoise 303 that are near other antenna structures. If instead the currents generated by one antenna structure were to retain high amplitude in the regions of the counterpoise 303 that are close to other antenna structures, such currents would cause coupling with the other antennas. Reducing the amplitude of such currents thus reduces the coupling while still allowing the four antenna structures to share the counterpoise 303. Thus, the antenna MIMO antenna 1201 is configured to reduce such currents and thus reduce the coupling between the antenna structures.

Figure 13:
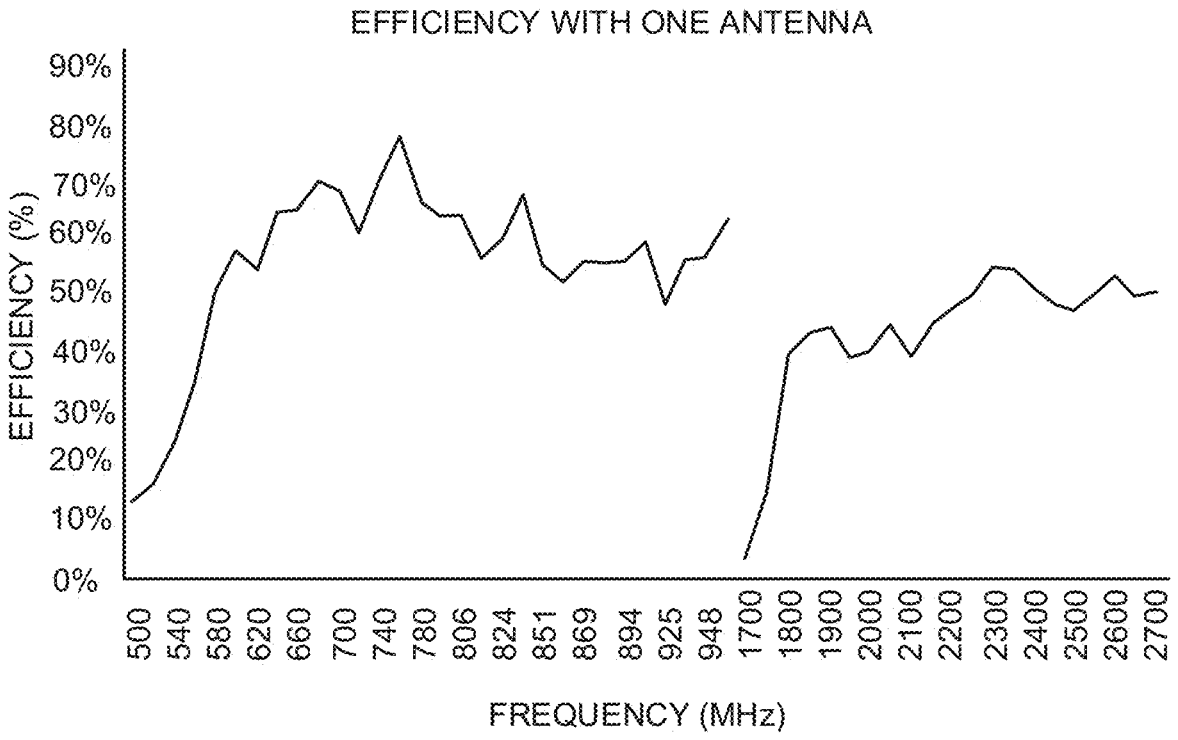
FIG. 13 is a graph illustrating the efficiency of an antenna consistent with the present disclosure.
Figure 14:
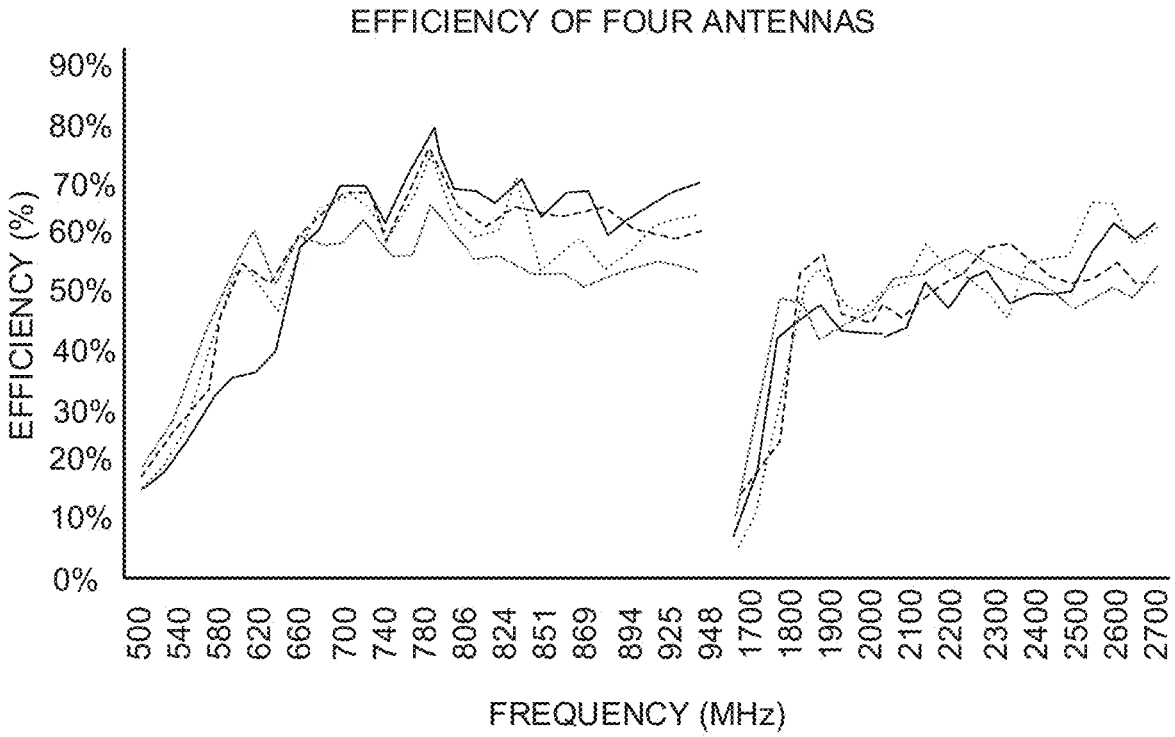
FIG. 14 is a graph illustrating the efficiency of a multiple-input multiple-output consistent with the present disclosure.

FIGS. 13 and 14 are graphs illustrating the performance of antenna structure 1101 and MIMO antenna 1201. Specifically, FIG. 13 illustrates the efficiency of antenna structure 1101 in frequency ranges from approximately 500 MHz to 1000 MHz and 1700 MHz to 2700 MHz. The results shown in FIG. 13 were obtained from an antenna structure 1101 operating in a single-input single output fashion, alone on a printed circuit board. As illustrated in FIG. 13, antenna structure 1101 shows excellent efficiency results in a low frequency band between 580 MHz and 1000 MHz and in a high frequency band between 1800 MHz and 2700 MHz.

FIG. 14 illustrates the efficiency of multiple antenna structure 1101, 1102, 1103, 1104 sharing a counterpoise and operating together as a MIMO antenna 1201. As illustrated in FIG. 14, despite the presence of three additional antenna structures transmitting and receiving, antenna structures 1101, 1102, 1103, and 1104 continue to demonstrate excellent efficiency results in a low frequency band between 580 MHz and 1000 MHz and in a high frequency band between 1800 MHz and 2700 MHz.

Figure 15:
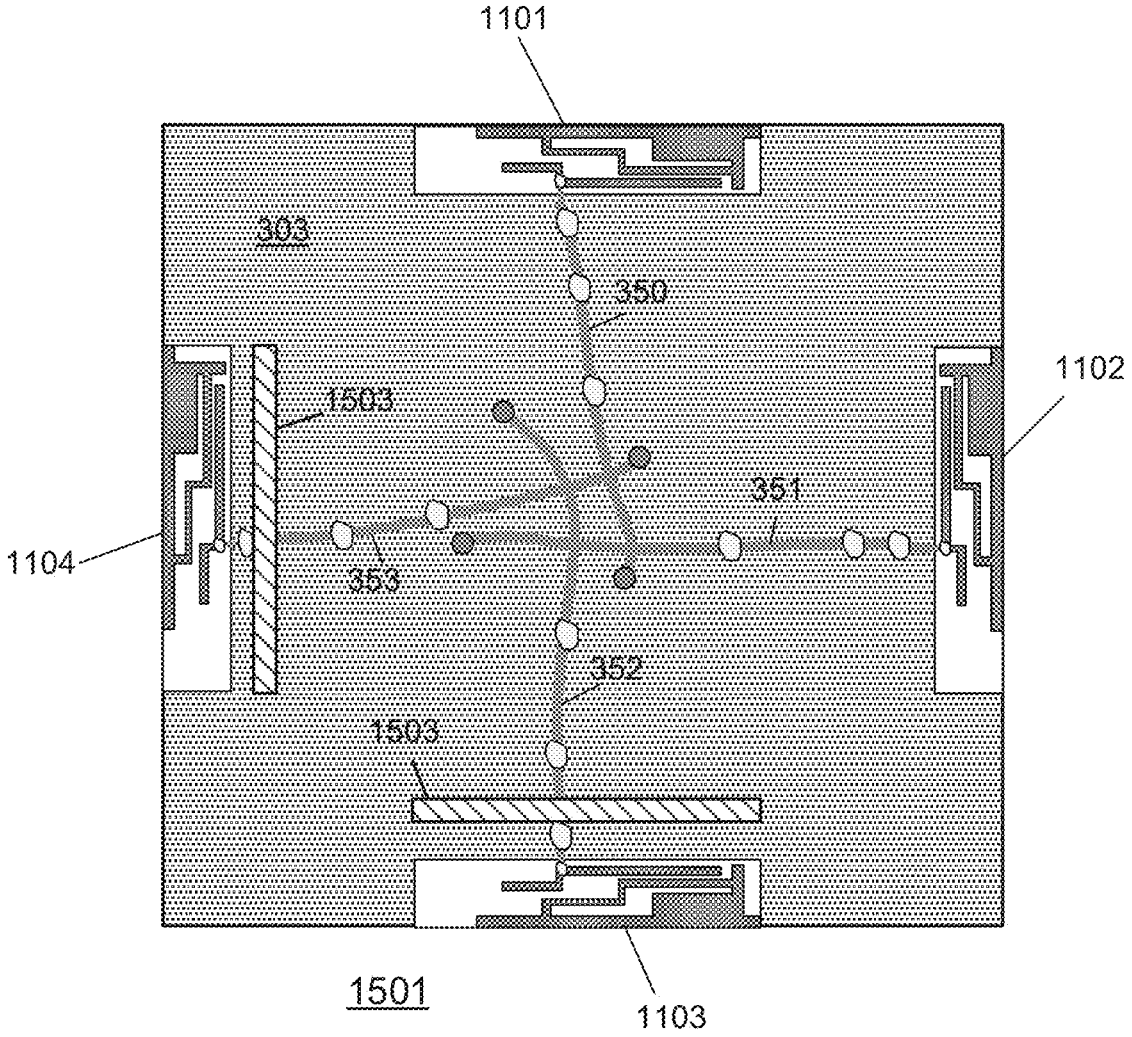
FIG. 15 illustrates the structure of a multiple-input multiple-output antenna consistent with the present disclosure.

FIG. 15, illustrates another embodiment of a MIMO antenna 1501. The antenna 1501 is similar to the antenna 1201 of FIG. 12, but with the addition of current limiting structures 1503 that are formed in the counterpoise 303. These current limiting structures 1503 can be implemented as extensions of the counterpoise 303 that extend or protrude upward, away from the plane of the counterpoise 303. Thus, the current limiting structures 1503 can be perpendicular to the plane of the counterpoise 303 and to the plane of the antenna structures 1101, 1102, 1103 and 1104. In general, the length and/or height of such an extension would be selected to form a preferred current path for RF current. Specifically, the length of the extensions in current limiting structures 1503 can be selected to form resonant structures with antenna structures 1103 and 1104. For antennas structures 1101 and 1102 the distance from the extensions is relatively large, and the current intensity is thus relatively low, and thus the current limiting structures 1503 do not resonate with those antennas.

Figure 16:
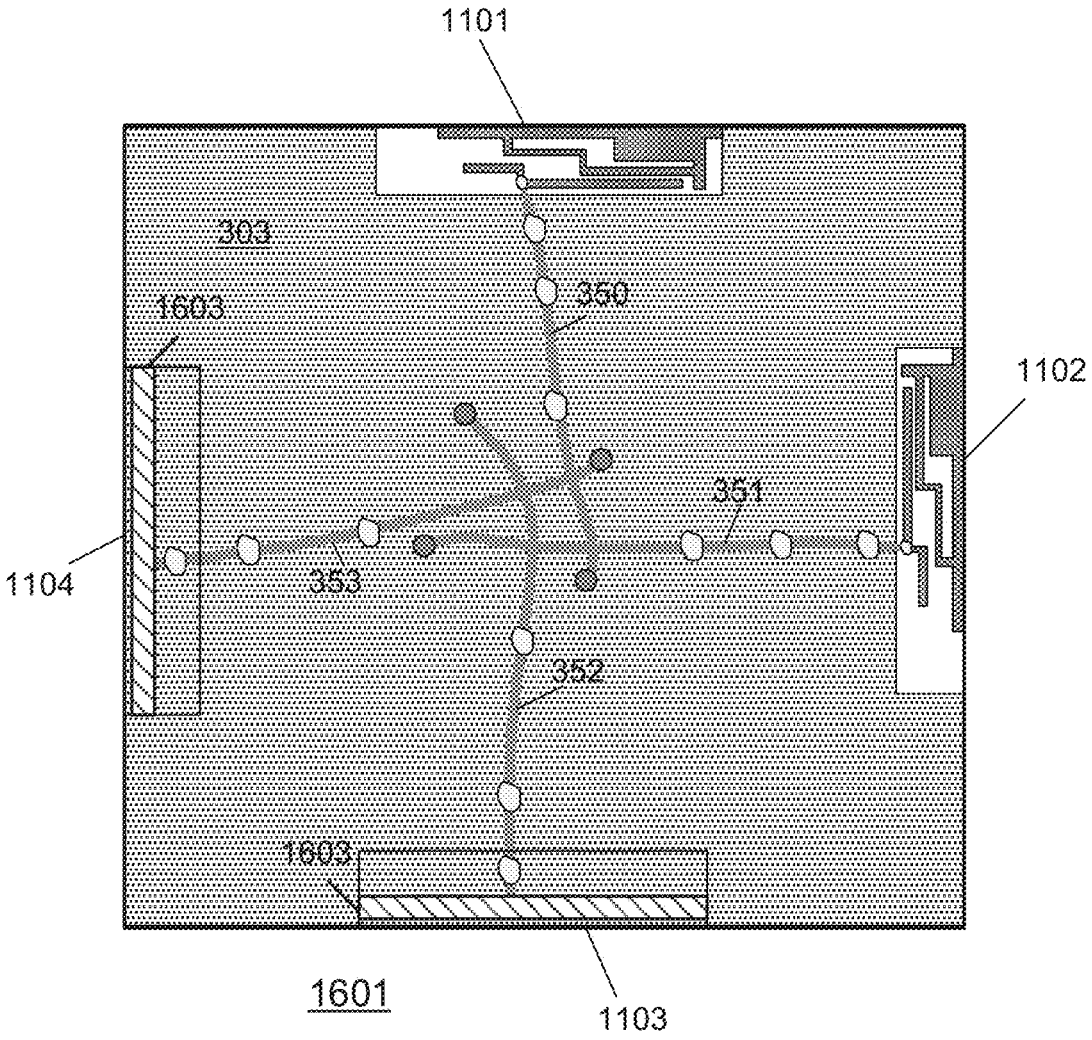
FIG. 16 illustrates the structure of a multiple-input multiple-output antenna consistent with the present disclosure.

FIG. 16 illustrates another embodiment of a MIMO antenna 1601. The antenna 1601 is similar to the antenna 1201 of FIG. 12, but in this case two of the antenna structures are formed on the opposite side of the counterpoise 303. Specifically, in this embodiment the antenna structures 1103 and 1104 are formed on the back side of the counterpoise 303, and are thus not seen in this figure. Because they are formed on the backside, the antenna structures 1103 and 1104 are on a different plane compared to antenna structures 1101 and 1102. Putting the two antenna structures 1103 and 1104 on the back side and thus in a different plane reduces current coupling between antenna structures 1101 and 1102 and can thus reduce interference between antenna structures.

Additionally, in the embodiment of FIG. 16 current limiting structures 1603 are again formed in the counterpoise 303. These current limiting structures 1603 can again be implemented as extension structures that protrude and extend away from the plane of the counterpoise 303. When so formed, the current limiting structures 1603 are also in a different plane compared to the antenna structures 1101, 1102, 1103 and 1104. Furthermore, in this embodiment the current limiting structures 1603 are on opposite sides of the counterpoise 303 compared to their adjacent antenna structures 1103 and 1104.

Again, each current limiting structure 1603 can include an extension from the counterpoise 303 surface, with the length of the extension selected to form a preferred current path for RF current. Specifically, the length of the extensions can be selected to form resonant structures with antenna structures 1103 and 1104 even though those antenna structures are on opposite sides of the printed circuit board. For antenna structures 1101 and 1102, the distance from the extensions is again relatively large, the current intensity is thus relatively low, and the extensions would thus not resonate with those antenna structures.

Figure 17:
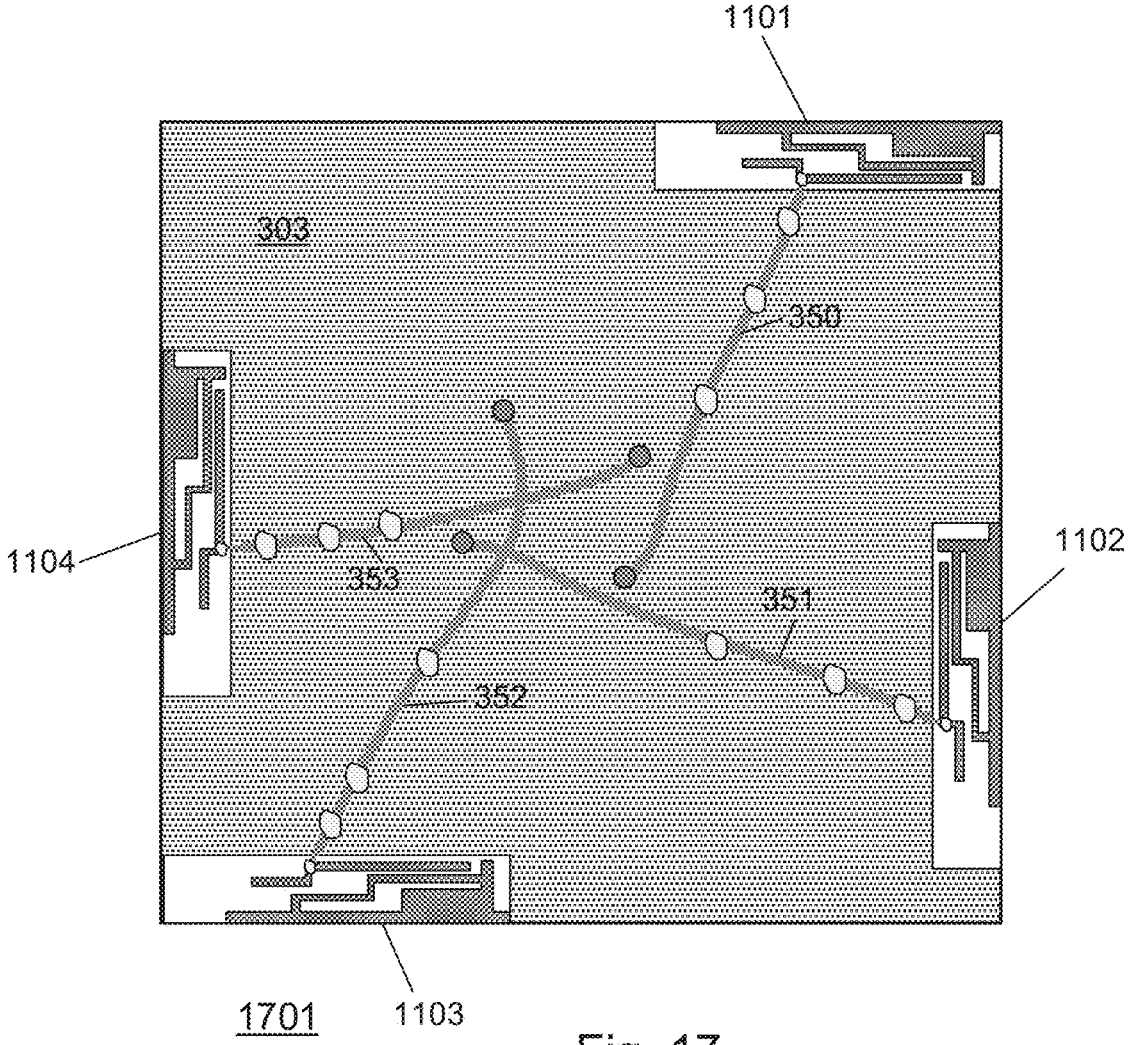
FIG. 17 illustrates the structure of a multiple-input multiple-output antenna consistent with the present disclosure.

FIG. 17, illustrates another embodiment of a MIMO antenna 1701. The antenna 1701 is similar to the antenna 1201 of FIG. 12, but in this case the four antenna structures are thus not equally spaced around the counterpoise 303. Specifically, in this embodiment the antenna structures 1103 and 1104 are positioned relatively close together, and antenna structures 1101 and 1102 are positioned relatively close together. Additionally, the antenna structures 1101 and 1103 are positioned relatively close to respective corners, while the other antenna structures 1102 and 1104 are relatively far from their closest corners.

In such an embodiment, the corner locations of antenna structures 1101 and 1103 can cause the radiation pattern resulting from associated currents to tilt. Specifically, the radiation pattern caused by currents in the counterpoise 303 from one antenna structure can tilt to the left, while the radiation pattern for the other antenna structure tilts to the right. This tilting in different directions reduces the coupling caused by the currents and associated radiation patterns.

Additionally, the asymmetric location of the antenna structure 1102 will also alter the resulting current induced radiation pattern. These altered radiation patterns can also increase the isolation between antenna structures, allowing even smaller sized counterpoises and associated devices. However, in some cases this can also result in less than ideal radiation patterns.

In one embodiment, a multiple-input multiple-output antenna is provided, the antenna comprising: a counterpoise; a first antenna structure, the first antenna structure including: a first parallel resonance element configured to resonate in at least one frequency, a first serial resonance component configured to resonate at a first frequency and configured to couple to the first parallel resonance element, and s first distributed feed element connected to a first feed line and configured to deliver a radiofrequency signal and couple to the first parallel resonance element and first serial resonance component at the first frequency; and a second antenna structure, the second antenna structure including: a second parallel resonance element configured to resonate in at least one frequency, a second serial resonance component configured to resonate at the first frequency and configured to couple to the second parallel resonance element, and a second distributed feed element connected to a second feed line and configured to deliver a radiofrequency signal and couple to the second parallel resonance element and second serial resonance component at the second frequency, wherein the first parallel resonance element and the second parallel resonance element are at least partially defined by the counterpoise.

In another embodiment, a wireless device is provided comprising: a conductive chassis; a first conductive coupling element having one end connected to the conductive chassis, the first conductive coupling element and the conductive chassis cooperating to form a first slit therebetween; and a first elongate feed element disposed at least partially in the slit between the first coupling element and the chassis; a second conductive coupling element having one end connected to the conductive chassis, the second conductive coupling element and the conductive chassis cooperating to form a second slit therebetween; and a second elongate feed element disposed at least partially in the slit between the second coupling element and the chassis; wherein a portion of the first coupling element and the chassis are configured to couple together and radiate in at least one frequency band when supplied with a radiofrequency signal in the at least one frequency band by the first elongate feed element, wherein a portion of the second coupling element and the chassis are configured to couple together and radiate in the at least one frequency band when supplied with a radiofrequency signal in the at least one frequency band by the second elongate feed element.

The foregoing descriptions of the embodiments of the present application have been presented for purposes of illustration and description. They are not exhaustive and do not limit the application to the precise form disclosed. Modifications and variations are possible in light of the above teachings or may be acquired from practicing the disclosed embodiments. For example, several examples of antennas embodying the inventive principles described herein are presented. These antennas may be modified without departing from the inventive principles described herein.

Additional and different antennas may be designed that adhere to and embody the inventive principles as described. Antennas described herein are configured to operate at particular frequencies, but the antenna design principles presented herein are limited to these particular frequency ranges. Persons of skill in the art may implement the antenna design concepts described herein to create antennas resonant at additional or different frequencies, having additional or different characteristics.

Other embodiments of the present application will be apparent to those skilled in the art from consideration of the specification and practice of the embodiments disclosed herein. It is intended that the specification and examples be considered as exemplary only.

What is claimed is:

1. A multiple-input multiple-output antenna, comprising:

a counterpoise having a nonlinear ground edge;

a first antenna structure, the first antenna structure including a first parallel resonance element, the first parallel resonance element including at least one capacitive element and at least one inductive element electrically coupled in parallel and configured to resonate in at least one frequency; and a second antenna structure, the second antenna structure including a second parallel resonance element, the second parallel resonance element including at least one capacitive element and at least one inductive element electrically coupled in parallel and configured to resonate in the at least one frequency, wherein the first parallel resonance element and the second parallel resonance element are at least partially defined by the counterpoise.

2. The multiple-input multiple-output antenna of claim 1, wherein first antenna structure further comprises:

a first serial resonance component, the first serial resonance component including at least one capacitive element and at least one inductive element electrically coupled in series and configured to resonate at a first frequency and configured to couple to the first parallel resonance element; and a first distributed feed element connected to a first feed line and configured to deliver a radiofrequency signal and couple to the first parallel resonance element and first serial resonance component at the first frequency.

3. The multiple-input multiple-output antenna of claim 2, wherein second antenna structure further comprises a second serial resonance component, the second serial resonance component including at least one capacitive element and at least one inductive element electrically coupled in series and configured to resonate at a second frequency and configured to couple to the second parallel resonance element; and a second distributed feed element connected to a second feed line and configured to deliver a radiofrequency signal and couple to the second parallel resonance element and second serial resonance component at the second frequency.

4. The multiple-input multiple-output antenna of claim 1, wherein the first antenna structure and the second antenna structure are positioned on opposite edges of the edges of the counterpoise.

5. The multiple-input multiple-output antenna of claim 4, further comprising a third antenna structure and a fourth antenna structure, and wherein the third antenna structure and the fourth antenna structure are positioned on opposite edges of the counterpoise.

6. The multiple-input multiple-output antenna of claim 1, wherein the first antenna structure is defined on a first side of the counterpoise, and the second antenna structure is defined on a second side opposite the first side.

7. The multiple-input multiple-output antenna of claim 1, further comprising an extension structure defined in the counterpoise, the extension structure extending away from a surface of the counterpoise, and wherein the extension structure is proximate to the first antenna structure.

8. The multiple-input multiple-output antenna of claim 1, wherein first antenna structure, the second antenna structure, and the counterpoise are formed together on a printed circuit board.

9. The multiple-input multiple-output antenna of claim 8, wherein the printed circuit board has a first edge and a second edge, and wherein the first antenna structure is formed adjacent to said first edge, and the second antenna structure is formed adjacent to said second edge, and wherein the counterpoise is formed between said first edge and said second edge.

10. A multiple-input multiple-output antenna, comprising:

a printed circuit board, the printed circuit board including a perimeter having a first edge, a second edge, a third edge, and a fourth edge, the printed circuit board further including a center region;

a counterpoise formed on the center region of the printed circuit board, the counterpoise having a nonlinear ground edge;

a first antenna structure formed on the circuit board adjacent to the first edge, the first antenna structure including a first parallel resonance element, the first parallel resonance element including at least one capacitive element and at least one inductive element electrically coupled in parallel and configured to resonate in at least one frequency;

a second antenna structure formed on the circuit board adjacent to the second edge, the second antenna structure including a second parallel resonance element, the second parallel resonance element including at least one capacitive element and at least one inductive element electrically coupled in parallel and configured to resonate in the at least one frequency;

a third antenna structure formed on the circuit board adjacent to the third edge, the second antenna structure including a third parallel resonance element, the third parallel resonance element including at least one capacitive element and at least one inductive element electrically coupled in parallel and configured to resonate in the at least one frequency; and a fourth antenna structure formed on the circuit board adjacent to the fourth edge, the fourth antenna structure including a fourth parallel resonance element, the fourth parallel resonance element including at least one capacitive element and at least one inductive element electrically coupled in parallel and configured to resonate in the at least one frequency, and wherein the first parallel resonance element, the second parallel resonance element, the third parallel resonance element, and the fourth parallel resonance element are each at least partially defined by the counterpoise.

11. The multiple-input multiple-output antenna of claim 10, further comprising:

a first extension structure defined in the counterpoise proximate to the first antenna structure, the first extension structure extending away from a surface of the counterpoise and configured to form a resonate structure with the first antenna structure; and a second extension structure defined in the counterpoise proximate to the second antenna structure, the second extension structure extending away from the surface of the counterpoise and configured to form a resonate structure with the second antenna structure.

12. The multiple-input multiple-output antenna of claim 11, wherein the first antenna structure is formed on a first side of the printed circuit board, and wherein the second antenna structure is formed on the first side of the printed circuit board, and wherein the first extension structure extends away from the first side of the printed circuit board, and wherein the second extension structure extends away from the first side of the printed circuit board.

13. A multiple-input multiple-output antenna, comprising:

a printed circuit board, the printed circuit board including a perimeter having a first edge, a second edge, a third edge, and a fourth edge, the printed circuit board further including a center region;

a counterpoise formed on the center region of the printed circuit board;

a first antenna structure formed on the circuit board adjacent to the first edge, the first antenna structure including a first parallel resonance element configured to resonate in at least one frequency;

a second antenna structure formed on the circuit board adjacent to the second edge, the second antenna structure including a second parallel resonance element configured to resonate in the at least one frequency;

a third antenna structure formed on the circuit board adjacent to the third edge, the second antenna structure including a third parallel resonance element configured to resonate in the at least one frequency;

a fourth antenna structure formed on the circuit board adjacent to the fourth edge, the fourth antenna structure including a fourth parallel resonance element configured to resonate in the at least one frequency, and wherein the first parallel resonance element, the second parallel resonance element, the third parallel resonance element, and the fourth parallel resonance element are each at least partially defined by the counterpoise;

a first extension structure defined in the counterpoise proximate to the first antenna structure, the first extension structure extending away from a surface of the counterpoise and configured to form a resonate structure with the first antenna structure;

a second extension structure defined in the counterpoise proximate to the second antenna structure, the second extension structure extending away from the surface of the counterpoise and configured to form a resonate structure with the second antenna structure; and wherein the first antenna structure is formed on a first side of the printed circuit board, and wherein the second antenna structure is formed on the first side of the printed circuit board, and wherein the first extension structure extends away from a second side of the printed circuit board opposite the first side, and wherein the second extension structure extends away from the second side of the printed circuit board.

14. The multiple-input multiple-output antenna of claim 10, wherein the first antenna structure and the second antenna structure are formed on a first side of the printed circuit board, and wherein the third antenna structure and the fourth antenna structure are formed on a second side of the printed circuit board, the second side opposite the first side.

15. The multiple-input multiple-output antenna of claim 10, wherein the first antenna structure is adjacent a first corner of the printed circuit board, and wherein the second antenna structure is adjacent a second corner of the printed circuit board, wherein the first corner is opposite the second corner.

16. The multiple-input multiple-output antenna of claim 10, wherein the printed circuit board is configured as part of a device housing for a wireless communication device.

17. The multiple-input multiple-output antenna of claim 10, wherein each of the first antenna structure, second antenna structure, third antenna structure, and fourth antenna structure include:

a serial resonance component, the serial resonance component including at least one capacitive element and at least one inductive element electrically coupled in series and configured to resonate at a first frequency; and a distributed feed element.

18. A multiple-input multiple-output antenna, comprising:

a counterpoise having a nonlinear ground edge;

a first antenna structure, the first antenna structure including:

a first parallel resonance element, the first parallel resonance element including at least one capacitive element and at least one inductive element electrically coupled in parallel and configured to resonate in at least one frequency, a first serial resonance component, the first serial resonance component including at least one capacitive element and at least one inductive element electrically coupled in series and configured to resonate at a first frequency and configured to couple to the first parallel resonance element, and a first distributed feed element connected to a first feed line and configured to deliver a radiofrequency signal and couple to the first parallel resonance element and first serial resonance component at the first frequency; and a second antenna structure, the second antenna structure including:

a second parallel resonance element, the first parallel resonance element including at least one capacitive element and at least one inductive element electrically coupled in parallel and configured to resonate in at least one frequency, a second serial resonance component, the second serial resonance component including at least one capacitive element and at least one inductive element electrically coupled in series and configured to resonate at a second frequency and configured to couple to the second parallel resonance element, and a second distributed feed element connected to a second feed line and configured to deliver a radiofrequency signal and couple to the second parallel resonance element and second serial resonance component at the second frequency, wherein the first parallel resonance element and the second parallel resonance element are at least partially defined by the counterpoise.

19. The multiple-input multiple-output antenna of claim 18, further comprising:

a first extension structure defined in the counterpoise proximate to the first antenna structure, the first extension structure extending away from a surface of the counterpoise and configured to form a resonate structure with the first antenna structure; and a second extension structure defined in the counterpoise proximate to the second antenna structure, the second extension structure extending away from the surface of the counterpoise and configured to form a resonate structure with the second antenna structure.

* * * * *